US010260202B2

(12) United States Patent
Bemment et al.

(10) Patent No.: US 10,260,202 B2
(45) Date of Patent: Apr. 16, 2019

(54) RAILWAY POINTS, RAILWAY POINTS OPERATING APPARATUS AND RAILWAY TRACK CROSSING

(71) Applicant: Loughborough University, Leicestershire (GB)

(72) Inventors: Samuel David Bemment, Leicestershire (GB); Roger Dixon, Leicestershire (GB); Roger Morgan Goodall, Leicestershire (GB)

(73) Assignee: Loughborough University, Leicestershire (GB)

( * ) Notice: Subject to any disclaimer, the term of this patent is extended or adjusted under 35 U.S.C. 154(b) by 191 days.

(21) Appl. No.: 15/106,117

(22) PCT Filed: Dec. 17, 2014

(86) PCT No.: PCT/GB2014/053732

§ 371 (c)(1),
(2) Date: Jun. 17, 2016

(87) PCT Pub. No.: WO2015/092396

PCT Pub. Date: Jun. 25, 2015

(65) Prior Publication Data

US 2016/0319491 A1 Nov. 3, 2016

(30) Foreign Application Priority Data

Dec. 20, 2013 (GB) ..... 1322641
Dec. 20, 2013 (GB) ..... 1322660
Mar. 3, 2014 (GB) ..... 1403674.3

(51) Int. Cl.
*E01B 7/14* (2006.01)
*B61L 5/02* (2006.01)
(Continued)

(52) U.S. Cl.
CPC *E01B 7/14* (2013.01); *B61L 5/02* (2013.01); *B61L 5/10* (2013.01); *E01B 7/02* (2013.01); *E01B 7/06* (2013.01); *E01B 7/08* (2013.01)

(58) Field of Classification Search
CPC ..... B61L 5/00; B61L 5/02; B61L 5/10; E01B 7/00; E01B 7/02; E01B 7/06; E01B 7/08; E01B 7/14
See application file for complete search history.

(56) References Cited

U.S. PATENT DOCUMENTS 175,699 A 4/1876 Harreff
267,569 A 11/1882 Morden
(Continued)

FOREIGN PATENT DOCUMENTS

CH 684939 A5 2/1995
CZ 24854 U1 1/2013
(Continued)

OTHER PUBLICATIONS

International Preliminary Report on Patentability (Form PCT/IPEA/409) for International Patent Application No. PCT/GB2014/053732, dated Jan. 29, 2016, including separate sheets, Applicant's letter to EPO, dated Dec. 21, 2015, and amended claims 1-53 (21 pages total).

(Continued)

*Primary Examiner* — Robert J McCarry, Jr.
(74) *Attorney, Agent, or Firm* — Kilyk & Bowersox, P.L.L.C.

(57) ABSTRACT

A railway points arrangement 10 for a railway track junction comprises at least first and second pairs of longitudinally-extending, parallel-spaced static stock rails 12, 14, defining respectively a first route and a second route, and a pair of longitudinally-extending, parallel-spaced switch rails 16 which are movable between a first position in alignment
(Continued)

with the first pair of stock rails 12 to select the first route and a second position in alignment with the second pair of stock rails 14 to select the second route. At least one of the movable switch rails 16*a* cooperates with at least one stock rail 12, 14 of each of the first and second pairs of stock rails 12, 14 when the movable switch rails 16 are in the first and second positions, and the at least one switch rail 16 and the at least one stock rail 12, 14 are shaped to define a mating profile 50 which aligns the switch rail 16 and stock rail 12, 14 and prevents transverse movement of the switch rail 16 relative to the stock rail 12, 14.

19 Claims, 26 Drawing Sheets

(51) Int. Cl.

| | |
|---|---|
| ***B61L 5/10*** | (2006.01) |
| ***E01B 7/02*** | (2006.01) |
| ***E01B 7/06*** | (2006.01) |
| ***E01B 7/08*** | (2006.01) |

(56) References Cited

U.S. PATENT DOCUMENTS

| | | | |
|---|---|---|---|
| 934,086 | A | 9/1909 | Moore |
| 1,112,965 | A | 10/1914 | Anderson |
| 1,996,718 | A | 4/1935 | Caruthers |

FOREIGN PATENT DOCUMENTS

| | | | | | |
|---|---|---|---|---|---|
| DE | 2046391 | A1 | | 3/1972 | |
| DE | 2047760 | B1 | | 5/1972 | |
| DE | 2904359 | A1 | | 8/1980 | |
| DE | 102008028862 | A1 | | 12/2009 | |
| EP | 0922807 | A1 | | 6/1999 | |
| EP | 2743154 | A2 | | 6/2014 | |
| FR | 2392168 | A1 | | 12/1978 | |
| GB | 191115538 | A | | 7/1912 | |
| GB | 191228636 | A | | 12/1913 | |
| GB | 1329048 | | * | 8/1971 | ..... E01B 7/06 |
| GB | 1329048 | A | | 9/1973 | |
| GB | 1470668 | A | | 4/1977 | |
| KR | 20100098098 | A | | 9/2010 | |
| SU | 1194939 | A1 | | 11/1985 | |
| SU | 1221268 | A1 | | 3/1986 | |
| WO | 9419542 | A1 | | 9/1994 | |
| WO | 2015092396 | A2 | | 6/2015 | |

OTHER PUBLICATIONS

International Search Report, Form PCT/ISA/210, dated Jun. 7, 2015, for PCT/GB2014/053732, 6 pages.

Written Opinion of the International Searching Authority, Form PCT/ISA/237, dated Jul. 7, 2015, for PCT/GB2014/053732, 10 pages.

Written Opinion of the International Preliminary Examining Authority, Form PCT/IPEA/408, dated Dec. 11, 2015, for PCT/GB2014/053732, 10 pages.

Search Report for Application No. GB1322660.0, published by the UK Intellectual Property Office, dated Aug. 7, 2014, including 2-pages of Examination Report under Sections 17 &18(3).

Search Report for Application No. GB1322641.0, published by the UK Intellectual Property Office, dated Aug. 7, 2014, including 2-pages of Examination Report under Sections 17 &18(3).

Search Report for Application No. GB1403674.3, published by the UK Intellectual Property Office, dated Sep. 24, 2014.

* cited by examiner

RAILWAY POINTS, RAILWAY POINTS OPERATING APPARATUS AND RAILWAY TRACK CROSSING

TECHNICAL FIELD

The present disclosure relates to railway points and more particularly to a railway points arrangement for a railway track junction.

The present disclosure also relates to railway points operating apparatus for operating a railway points arrangement so that different routes can be selected through a railway track junction.

The present disclosure also relates to a railway track crossing at which the rails of two diverging railway tracks cross, for example defining a straight route and a turnout route. The diverging tracks are selectable in a conventional manner using a railway points arrangement so that rolling stock can travel along either the straight route or the turnout route.

TECHNICAL BACKGROUND

Railway points, also known as railway track switches, are a necessary part of all railway networks as they enable different routes through the network to be selected. They are a critical part of the network as a points failure often leads to delays, re-routing and cancellations. Even when fully operational, railway points represent a significant capacity constraint because they have to be operated in such a way to ensure that a route has been correctly set before rolling stock is allowed to pass the railway track junction.

In a traditional set of railway points, movable switch rails are located between stock rails. The stock rails are securely fixed to prevent movement and the free ends of the switch rails, which are linked together via stretcher bars, slide on suitable supports when commanded to move enabling either a straight route or a turnout route to be selected. Upon request from the signalling system, an actuator, which forms part of the lineside points operating equipment, moves the two switch rails via a linkage before locking the switch rails in position and communicating the detected position of the rails and the lock back to the signalling system. It is only once this process is complete that a train can be authorised to safely pass the track junction because during the 'transition' state, when the switch rails are not properly set to select either the straight route or the turnout route, the points present a derailment risk.

In an alternative type of railway points, commonly known as a stub switch, the ends of a pair of movable switch rails are moved between different positions into alignment with pairs of static stock rails to form a continuation of the main fixed rails on either side of the railway track junction. Stub switches have never achieved widespread usage for a number of reasons. One reason is difficulty aligning the free rail ends. If not correctly aligned, the loads on the free rail ends imparted by rolling stock can lead to premature wear of the rail ends and hence failure of the stub switch. Severe misalignment can, of course, also present a derailment risk. Another reason is that, as the rails expand during hot weather, the clearance between the free rail ends decreases and in extreme cases they can become jammed preventing movement of the switch rails and hence failure of the stub switch. Nevertheless, stub switches arguably offer significant advantages over the traditional railway points discussed above, including a reduced likelihood of blockages, the possibility of multiple routes from a single set of points, and cheaper modular construction using standard components.

A first object is, therefore, to provide a railway points arrangement, based on the stub switch design, which overcomes the drawbacks outlined above that are associated with railway points based on the traditional and stub switch designs.

Points operating apparatus (often referred to as lineside points operating equipment) is a key element of all railway points arrangements. Conventional points operating apparatus includes an actuator arrangement which moves the switch rails between different positions to select a desired route, for example a straight route or a turnout route, through a railway track junction. The actuator arrangement also locks the switch rails in the selected position.

In a traditional railway points arrangement, there is always a 'transition' state when the switch rails are not properly set to select either the straight route or the turnout route. When the switch rails are in this transition state, the points present a derailment risk, especially when rolling stock is executing a facing-point movement. If there is a failure of the points operating apparatus, for example a failure of part of the actuator arrangement, during this transition state, the switch rails of a conventional points arrangement become stuck in the transition state and cannot be moved by adjacent points operating apparatus because the faulty actuator arrangement prevents such movement. The points arrangement is consequently rendered inoperable and rolling stock cannot safely pass the railway track junction until remedial action is taken to repair or replace the points operating apparatus so that the points arrangement can be put back into service.

A second object is, therefore, to provide an improved railway points operating apparatus.

A conventional railway track junction 210 which allows rolling stock to follow different routes through the rail network is illustrated in FIG. 16. The railway track junction 210 includes a points arrangement 216, also known as a railway track switch, which enables different routes, for example a straight route 212 and a turnout route 214, to be selected through the railway track junction 210 by allowing rolling stock to transfer between different railway tracks. The points arrangement 216 illustrated in FIG. 1 comprises a traditional set of railway points in which movable switch rails 218 are located between stock rails 220. The stock rails 220 are securely fixed to prevent movement and the free ends of the switch rails 218, which are linked via stretcher bars (not shown in FIG. 1), slide transversely on suitable supports when commanded to move enabling either the straight route 212 or the turnout route 214 to be selected. As mentioned above, in an alternative type of railway points, commonly known as a stub switch, the ends of a pair of movable switch rails are moved transversely between different positions into alignment with pairs of fixed stock rails to form a continuation of the main fixed rails on either side of the railway track junction.

The railway track junction 210 includes a railway track crossing 222 where the rails of one track (e.g. the straight track) cross the rails of the other track (e.g. the turnout track). Also known as a "common crossing" or "frog", the railway track crossing 222 includes a v-section nose 224 which is formed by a pair of fixed diverging rails 226 (one of each track). A pair of wing rails 228 is located on either side of the nose 224 to strengthen the structure (transmit longitudinal stress) and to provide a smooth transfer of load.

In a "fixed" crossing such as that shown in FIG. 16, which is the most common type of railway track crossing, the v-section nose 224 and wing rails 228 are fixed in position and the wing rails 228 are spaced apart from the v-section nose 224 by a small distance to form a groove 230 between each wing rail 228 and the nose 224 through which the wheel flanges of the rolling stock wheels can pass. Check rails 234 are provided to ensure that the wheels follow the correct route through the railway track crossing 222 and to ensure that the rolling stock does not derail. Before a wheel flange can engage in one of the grooves 230, the wheel must first traverse a gap 232 formed by the other groove 230 between the nose 224 and the other wing rail 228. The wheel is temporarily unsupported as it traverses this gap 232 and the impact between the wheel and the nose/wing rails results in both noise and an increased rate of wear of the nose 224 and the wing rails 228. In an attempt to address these problems, "swing nose" and "swing wing" crossings have been proposed.

In a swing nose crossing, the v-section nose 224 can move transversely so that it contacts one of the wing rails 228 and closes the gap 232 between the nose 224 and the wing rail 228 to provide a continuous length of rail for the wheels of the rolling stock. It will be appreciated that the position of the nose 224 (and hence which of the wing rails 228 it contacts) will vary according to the setting of the points arrangement 216 and, hence, whether the straight track or the turnout track needs to be selected. Swing nose crossings can either be "passive", meaning that the v-section nose 224 is moved transversely by the wheels of rolling stock, or "active", meaning that the v-section nose 224 is moved by an actuator arrangement. It should be noted that in a "passive" swing nose crossing, the v-section nose 224 is only moved transversely by the wheels of rolling stock when the rolling stock passes through the crossing in the trailing-point direction, i.e. the converging direction of the rails forming the v-section nose 224.

In a swing wing crossing, the v-section nose 224 is fixed and one or both of the wing rails 228 is movable. One example of a "passive" swing wing crossing is described in GB 1587042. In this passive arrangement, one of the wing rails is fixed whilst the other wing rail is flexible and can be moved transversely, from a closed position to an open position, by a passing wheel of rolling stock. In the closed position (set for the straight route), the flexible wing rail contacts the nose to provide a continuous running surface along the straight route for the rolling stock wheels. In the open position (set for the turnout route), the movable wing rail is pushed away from the nose by a passing wheel flange so that the rolling stock can travel along the turnout route. When following the turnout route, the wheels still have to traverse a gap between the fixed wing rail and the nose but this is not problematic if the turnout speed is quite low. In practice, there is an increasing demand for higher turnout speeds in order to increase network capacity. As a result, "active" swing wing crossings have been proposed in which an actuator arrangement is provided to move the wing rails transversely into and out of contact with the nose so that there are no gaps (i.e. a continuous running surface) when rolling stock travels along either the straight route or the turnout route.

Despite the obvious advantages of swing nose and swing wing crossings, including reduced wear of the v-section nose and wing rails, reduced noise and higher possible turnout speeds, they have seen limited use in the UK. This is because the aforementioned advantages are outweighed by disadvantages such as high cost, complexity and poor reliability. In fact, swing nose crossings are no longer fitted on the UK mainline rail network due to performance and reliability issues.

A third object is, therefore, to provide a railway track crossing which overcomes these disadvantages.

SUMMARY OF THE DISCLOSURE

In order to solve the first object, the present disclosure provides a railway points arrangement as defined below.

According to a first aspect of the present disclosure, there is provided a railway points arrangement for a railway track junction, the railway points arrangement comprising:

at least first and second pairs of longitudinally-extending, parallel-spaced static stock rails defining respectively a first route and a second route;

a pair of longitudinally-extending, parallel-spaced switch rails movable vertically and transversely between a first transverse position in alignment with the first pair of stock rails to select the first route and a second transverse position in alignment with the second pair of stock rails to select the second route;

wherein at least one of the movable switch rails cooperates with at least one stock rail of the first pair of stock rails when the movable switch rails are in the first transverse position and with at least one stock rail of the second pair of stock rails when the movable switch rails are in the second transverse position, said at least one switch rail and said at least one stock rail being shaped to define a mating profile which aligns the switch rail and stock rail and prevents transverse movement of the switch rail relative to the stock rail when the switch rails are in the first transverse position or the second transverse position, the mating profile being formed by an upper surface of the stock rail and a lower surface of the switch rail.

The mating profile between the switch rail and stock rail ensures that the switch rail and stock rail are correctly aligned when the switch rails are in the first and second transverse positions and further ensures that the switch rails cannot move from either the first or second transverse position in a transverse horizontal direction. The switch rails can move vertically and transversely between the first transverse position and the second transverse position only if specifically commanded to do so. The railway points do not, therefore, rely exclusively on lineside points operating apparatus to accurately align the switch rails with the stock rails and to lock the switch rails in the selected position.

It is possible, in one embodiment, that only one of the movable switch rails cooperates with a corresponding stock rail of each of the first and second pairs of stock rails when the movable switch rails are in the first and second positions. In this embodiment, only one of the switch rails and one of the stock rails of each of the first and second pairs of stock rails are shaped to define a mating profile. The other switch rail and stock rail of each pair can have a conventional stub switch design in which the facing ends of the rails are longitudinally separated. Such an arrangement typically requires that the switch rails are secured together, for example by a stretcher bar, to ensure proper alignment between both switch rails and both stock rails of each of the first and second pairs and to ensure that both switch rails are constrained against transverse horizontal movement relative to the stock rails.

In preferred embodiments, both of the movable switch rails cooperate with both stock rails of each of the first and second pairs of stock rails when the movable switch rails are in the first and second positions, and both switch rails and both stocks rails in each of the first and second pairs are shaped to define a mating profile which aligns the switch rails and stock rails and prevents transverse movement of the switch rails relative to the stock rails. This arrangement may be preferred because each switch rail is independently aligned with a corresponding stock rail and independently transversely constrained.

The mating profile may be arranged to permit the switch rail to be moved vertically relative to the stock rail to engage and disengage the mating profile. The vertical motion may be about an arcuate path. The switch rails can, thus, be moved transversely and vertically, possibly simultaneously transversely and vertically, about said arcuate path between the first and second positions so that either the first or second route can be selected. Because the switch rail must be raised, for example by an actuator arrangement, to disengage the mating profile to permit movement of the switch rails between the first and second positions, there is no risk of unintended movement of the switch rails between the first and second positions in a transverse horizontal direction.

The mating profile may be arranged to permit relative longitudinal movement between the switch rail and the stock rail with which it cooperates when the switch rails are in the first and second positions. By arranging the mating profile to permit relative longitudinal movement, thermal expansion and contraction can take place at the interface between the switch rail and the stock rail without the switch rails and stock rails becoming jammed together. The running surfaces of the switch rail and stock rail remain coplanar in the event of any relative longitudinal movement.

The mating profile may comprise a convex profile section and a complementary shaped concave profile section. The convex profile section may extend upwardly from the stock rail and the concave profile section may be formed in the switch rail, for example in a lower surface thereof. This arrangement is advantageous because the concave profile section is inverted and cannot become blocked with debris which could prevent the convex profile section from properly locating in the concave profile section. Nevertheless, it is possible that the convex profile section could extend downwardly from the switch rail, for example from a lower surface thereof, and that the concave profile section could be formed in the stock rail, for example in an upper surface thereof.

The mating profile could comprise a plurality of cooperating mating surfaces. For example, the stock rail could include a plurality of mating surfaces which cooperate with corresponding mating surfaces on the switch rail.

Generally, a relatively simple geometry is preferred to facilitate manufacture of the rails. Accordingly, the mating profile may comprise a generally V-section profile. Thus, the switch rail and the stock rail may each include two cooperating mating surfaces. The V-section profile may be inverted which provides an arrangement in which the convex profile section advantageously extends upwardly from the stock rail and the concave profile section is advantageously formed in the switch rail.

In an alternative embodiment, the mating profile may be a generally U-section profile and the U-section profile may be inverted.

In typical embodiments, a recess or expansion gap may be defined between facing end surfaces of the switch rail and the stock rail with which it cooperates when the switch rails are in the first and second positions. The recess or gap ensures that any longitudinal movement due to thermal expansion can be readily accommodated without the switch rails and stock rails becoming jammed together.

The switch rail and the stock rail may be tapered in the longitudinal direction to define a mitred connection between the switch rail and the stock rail. The mitred connection advantageously permits relative longitudinal movement between the switch rail and the stock rail. Again, this ensures that any longitudinal movement due to thermal expansion can be readily accommodated without any resultant discontinuity in the running surface at the interface between the switch rail and the stock rail.

In order to solve the second object, the present disclosure provides a railway points operating apparatus as defined below.

According to a second aspect of the present disclosure, there is provided railway points operating apparatus for a railway points arrangement comprising at least first and second pairs of longitudinally-extending, parallel-spaced static stock rails defining respectively a first route and a second route and a pair of switch rails movable between a first position to select the first route and a second position to select the second route, wherein the railway points operating apparatus comprises:

- an actuator arrangement for moving the switch rails transversely and vertically about an arc between the first and second positions so that the switch rails are raised and lowered relative to the stock rails during said transverse movement; and
- a locking arrangement for preventing transverse horizontal movement of the switch rails from the first and second positions.

According to a third aspect of the present disclosure, there is provided a railway points arrangement comprising:

- at least first and second pairs of longitudinally-extending, parallel-spaced static stock rails defining respectively a first route and a second route;
- a pair of longitudinally-extending switch rails movable between a first position to select the first route and a second position to select the second route; and
- railway points operating apparatus comprising:
  - an actuator arrangement for moving the switch rails transversely and vertically about an arc between the first and second positions so that the switch rails are raised and lowered relative to the stock rails during said transverse movement; and
  - a locking arrangement for preventing transverse horizontal movement of the switch rails from the first and second positions.

The switch rails may be longitudinally-extending, parallel-spaced switch rails. The switch rails may be aligned with the first pair of stock rails when in the first position to thereby select the first route. The switch rails may be aligned with the second pair of stock rails when in the second position to thereby select the second route. The points arrangement may, thus, take the form of a stub switch.

The switch rails may alternatively be located between incoming stock rails. A free end of one of the switch rails may contact one of the incoming stock rails when the switch rails are in the first position to thereby select the first route. A free end of the other switch rail may contact the other incoming stock rail when the switch rails are in the second position to thereby select the second route. The points arrangement may, thus, take the form of traditional railway points.

According to a fourth aspect of the present disclosure, there is provided railway points operating apparatus for a railway points arrangement comprising at least first and second pairs of longitudinally-extending, parallel-spaced static stock rails defining respectively a first route and a second route and a pair of longitudinally-extending, parallel-spaced switch rails movable between a first position in alignment with the first pair of stock rails to select the first route and a second position in alignment with the second pair of stock rails to select the second route, wherein the railway points operating apparatus comprises:

an actuator arrangement for moving the switch rails transversely and vertically about an arc between the first and second positions so that the switch rails are raised and lowered relative to the stock rails during said transverse movement; and a locking arrangement for preventing transverse horizontal movement of the switch rails from the first and second positions.

According to a fifth aspect of the present disclosure, there is provided a railway points arrangement comprising:

at least first and second pairs of longitudinally-extending, parallel-spaced static stock rails defining respectively a first route and a second route;

a pair of longitudinally-extending, parallel-spaced switch rails movable between a first position in alignment with the first pair of stock rails to select the first route and a second position in alignment with the second pair of stock rails to select the second route; and railway points operating apparatus comprising:

an actuator arrangement for moving the switch rails transversely and vertically about an arc between the first and second positions so that the switch rails are raised and lowered relative to the stock rails during said transverse movement; and a locking arrangement for preventing transverse horizontal movement of the switch rails from the first and second positions.

The railway points arrangement typically comprises a plurality of said railway points operating apparatus located at longitudinally spaced positions along the switch rails. The provision of a plurality of points operating apparatus is advantageous because it ensures that the switch rails are correctly supported and aligned along their length and that the necessary degree of redundancy is provided. Accordingly, if there is a failure of one of the points operating apparatus, for example a failure of any part of the actuator arrangement, it may still be possible to move the switch rails between the first and second positions by operating other points operating apparatus. In these circumstances, the railway points arrangement can remain in operation and the defective points operating apparatus can simply be replaced at a convenient time without requiring a track possession.

The redundancy capability is facilitated by the separate actuation and locking functions provided respectively by the actuator arrangement and the locking arrangement. For example, if there is a failure of any part of the actuator arrangement, the points operating apparatus with the failed actuator arrangement can still lock the switch rails in the first and second positions because locking is achieved passively, without any reliance on the actuator arrangement.

In the unlikely event of a failure of any part of the actuator arrangement of a points operating apparatus whilst the switch rails are in a transition state, between the first and second positions, and where other points operating apparatus are unable to move the switch rails to either the first or second positions, the points operating apparatus ensures that the railway points arrangement can never present a derailment risk to rolling stock executing a facing-point movement when the points arrangement is embodied as a stub switch or to rolling stock executing a trailing-point movement when the points arrangement is embodied as traditional railway points because the forces applied to the switch rails by approaching rolling stock allow the actuator arrangement to control the movement of the switch rails so that they safely move transversely and vertically about the aforesaid arc to either the first position or the second position. This is possible at least in part because, as explained above, the locking function is not provided by the actuator arrangement.

In traditional railway points, there is a need for supporting surfaces which allow low-friction horizontal sliding movement of the switch rails in the transverse direction and which at the same time provide adequate support for the loaded switch rails as rolling stock passes over them. These conflicting requirements are addressed by the present disclosure again due to the fact that the actuation and locking functions are separated. More particularly, the actuator arrangement may include bearing surfaces which can be configured to support the switch rails during movement about the arc between the first and second positions whilst the locking arrangement may include different bearing surfaces which can be configured to provide the necessary support for the loaded switch rails as rolling stock passes over them.

The actuator arrangement may be arranged to move the switch rails between the first and second positions about an arc which may be substantially semi-circular.

Because the switch rails are moved transversely and vertically about an arc between the first and second positions, contact, and hence friction, with supporting surfaces is minimised thereby increasing the reliability of the points operating apparatus. This is to be contrasted with conventional points operating apparatus where the switch rails slide across a supporting surface as explained above.

The points operating apparatus may include a support member which may have an upper surface on which the switch rails may be mounted in a predetermined spaced relationship. The actuator arrangement may be operable to move the support member about said arc to thereby move the switch rails between the first and second positions. Typically, the switch rails are removably secured to the upper surface of the support member, for example using suitable clips and mounts. This enables the points operating apparatus to be configured as a self-contained line replaceable unit which is readily attachable/detachable to/from the switch rails and therefore readily interchangeable in the event of failure of any part of the apparatus without requiring a track possession.

The support member may have a lower surface and a plurality of transversely spaced recesses may be provided on the lower surface. Each recess may include a bearing surface and each bearing surface may have a substantially semi-circular profile or an inverted substantially U-shaped profile. The recesses may be formed in a plate member mounted on the lower surface of the support member. The recesses could alternatively be formed in the lower surface of the support member.

The locking arrangement may include an upwardly extending locking projection which may locate in one of the transversely spaced recesses when the switch rails are in the first and second positions to prevent transverse horizontal movement of the support member. The cooperation between the locking projection and the transversely spaced recesses thus prevents transverse horizontal movement of the switch rails and holds them securely in the selected first or second position. It will, therefore, be appreciated that the locking projection and recesses are transversely positioned to ensure that when the locking projection is positioned in a recess, the switch rails are positioned to select either the first route or the second route, for example by virtue of alignment of the switch rails with either the first or second pair of stock rails.

The locking projection may have a bearing surface which cooperates with the bearing surface of each recess to transversely align the locking projection and recess about a vertical axis when the switch rails are in the first and second positions. The cooperation between the bearing surfaces advantageously guides the support member transversely and vertically in an arcuate motion (i.e. along a curved path) during movement between the first and second positions so that the switch rails are properly positioned to select either the first route or second route, for example by virtue of alignment of the switch rails with either the first or second pair of stock rails. The bearing surface of the locking projection typically has a substantially semi-circular profile or inverted U-shaped profile which may be complementary to the semi-circular profile or inverted U-shaped profile bearing surface of each recess.

The actuator arrangement may include an actuating member which may cooperate with the support member to move the support member, and hence the switch rails, about said arc.

The actuating member may cooperate with the transversely spaced recesses to move the support member, and thereby move the switch rails, about said arc. The recess with which the actuating member cooperates will depend on the starting position of the switch rails, e.g. whether they are being moved from the first position to the second position or from the second position to the first position.

In preferred embodiments, the actuating member is disengaged from the transversely spaced recesses when the switch rails are in the first and second positions. This ensures that the actuation and locking functions provided by the points operating apparatus are entirely separate. It also allows the actuating member to gain momentum prior to locating in the recess when movement of the support member, and hence the switch rails, is initiated, thereby overcoming any static friction.

The actuating member may comprise a rotatable cam member. The rotatable cam member may include a bearing surface which cooperates with the bearing surface of the recess during movement of the switch rails between the first and second positions.

The rotatable cam member may be mounted on a camshaft for rotation by the camshaft. The camshaft can be rotated to cause rotation of the cam member. It is this rotation which causes at least part of the cam member to engage and disengage the recesses. The actuator arrangement may include a drivetrain for rotating the camshaft and the drivetrain may be backdrivable. This is advantageous because if any part of the actuator arrangement fails during movement of the switch rails between the first and second positions whilst the switch rails are in a transition state, the switch rails can move from the transition state to either the first position or the second position. As explained above, this movement could be effected by the actuator arrangements of other points operating apparatus located at longitudinally spaced positions along the switch rails or by forces applied to the switch rails by rolling stock passing the switch rails.

The drivetrain typically includes a motor and may include a gearbox arrangement.

The drivetrain may include a slip clutch which may have a predetermined slip torque. This may be advantageous, for example, in the unlikely event that the switch rails become stuck in a transition state between the first and second positions and cannot be moved to either the first or second positions by other points operating apparatus. In these circumstances, the forces applied to the switch rails by approaching rolling stock would generate a torque in the drivetrain which is greater than the predetermined slip torque thereby allowing the clutch to slip and the switch rails to move to either the first or second positions into a safe state in which the rolling stock can safely pass the points arrangement.

In order to solve the third object, the present disclosure provides a railway track crossing as defined below.

According to a sixth aspect of the present disclosure, there is provided a railway track crossing comprising:

- a fixed crossing nose formed by a pair of diverging rails;
- a pair of independently movable rails each having a wing rail section provided on each side of the fixed crossing nose, each rail being movable transversely from a closed position in which the wing rail section contacts the crossing nose to an open position in which the wing rail section is spaced from the crossing nose to form a groove that allows the passage of a wheel flange between the crossing nose and the wing rail section; and
- an actuator arrangement which is operable to move a selected one of the movable rails from the closed position to the open position, each movable rail being arranged to adopt the closed position in the absence of any force applied to it by the actuator arrangement;
- wherein each movable rail includes a first mating feature which cooperates with a second mating feature to lock the movable rail in the closed position when the movable rail is loaded by the wheels of rolling stock passing through the railway track crossing.

The actuator arrangement moves a selected one of the movable rails from the closed position to the open position when rolling stock needs to travel along either the straight route or the turnout route. The other movable rail remains in the closed position, with its wing rail section in contact with the fixed crossing nose to provide a continuous running surface for the rolling stock wheels, and is positively locked in the closed position by the weight of passing rolling stock acting on the movable rail. The locking of each movable rail in the closed position is, therefore, achieved entirely passively by virtue of cooperation between the first and second mating features and does not rely on the actuator arrangement or other active locking mechanisms. The railway track crossing is consequently safer and more reliable than existing railway track crossings and can accommodate high turnout speeds because the wheels of passing rolling stock are fully supported throughout the crossing, in contrast to existing fixed crossings as discussed above.

Because the movable rails are arranged to adopt the closed position in the absence of any force applied by the actuator arrangement, the movable rails remain in the closed position at all times when the railway track crossing is not in use (i.e. when rolling stock is not passing through the railway track crossing). Accordingly, there is minimal risk of the movable rails becoming stuck in the open position, for example as a result of a blockage formed by debris becoming lodged in the groove between an open wing rail section and the crossing nose.

An additional advantage is that rolling stock can safely pass through the railway track crossing in any direction and along any route, irrespective of the route for which the movable rails are actually set. The railway track crossing does not, therefore, present a derailment risk.

Each movable rail may adopt a first position in which its wing rail section is elevated above the crossing nose when the movable rail is not loaded by the wheels of rolling stock and each movable rail may be arranged to move downwardly, to a second position, when loaded by the wheels of rolling stock passing through the railway track junction. The first and second mating features may be arranged to cooperate when the movable rail is loaded by the wheels of rolling stock and thereby moved to the second position. Accordingly, the simple loading of the movable rail by the passing rolling stock and the consequent downward movement of the movable rail causes the loaded movable rail to be locked in the closed position as a result of the cooperation between the first and second mating features.

A running surface of each wing rail section may be elevated above a running surface of the crossing nose when each movable rail is not loaded by the wheels of rolling stock and in the first position. The running surface of each wing rail section may be substantially level or substantially coplanar with the running surface of the crossing nose when the movable rail is loaded by the wheels of rolling stock and in the second position. This ensures that a continuous running surface is provided for the wheels of rolling stock passing through the railway track crossing.

The railway track crossing may include a plurality of biasing means. The biasing means may be arranged to bias each movable rail into the elevated first position when each movable rail is not loaded by the wheels of rolling stock. The biasing means thus support the movable rails in the longitudinal direction (i.e. along the running direction of the rails) and ensure that the movable rails adopt the elevated first position when they are not loaded by the wheels of passing rolling stock. The biasing means may be arranged to bias each movable rail into the closed position. The biasing means thus ensure that each movable rail adopts the closed position when each movable rail is not loaded by the wheels of rolling stock and when no force is applied by the actuator arrangement. The biasing means thus help to place the movable rails, and hence the railway track crossing, in a neutral, safe, state.

The railway track crossing may include a plurality of dampers. At least one of said dampers may be arranged to retard the movement of each movable rail from the second position to the first position and possibly from the open position to the closed position. The dampers ensure that each movable rail does not repeatedly spring upwardly from the second position to the elevated first position (under the action of the biasing means) as each wheelset passes through (there could be a few seconds between each wheelset passing). Additionally, should a wheelset pass through with the movable rails, and hence the wing rail sections, set incorrectly for the desired route, the dampers would prevent the unloaded movable rail trying to slam to the closed position immediately after each wheel flange passes through the groove between the wing rail section and the crossing nose. Although this is a somewhat unlikely occurrence, it could potentially prevent a lot of noise, vibration and wear as a large number of wheelsets (e.g. upwards of forty wheelsets) pass through per train.

The first and second mating features may comprise a concave profile section extending longitudinally along the running direction of the movable rails and a complementary convex profile section extending longitudinally along the running direction of the movable rails. The convex profile section may extend downwardly from a lower flange of each movable rail. The concave profile section may open upwardly to accommodate the convex profile section when the movable rail is in the second position.

The railway track crossing may include a locking element positioned beneath the movable rail in which the upwardly opening concave profile section may be formed. In one embodiment, a separate locking element may be positioned beneath each movable rail. In another embodiment, a single locking element may extend transversely between the movable rails and may include transversely spaced concave profile sections positioned beneath each movable rail.

The convex profile section and the concave profile section may each include a bearing surface which may be configured to guide each movable rail downwardly to the second position when the movable rail is loaded by the wheels of rolling stock passing through the railway track crossing. The bearing surfaces may be configured to guide each movable rail upwardly from the first position to a third position, elevated above the first position, when the movable rail is moved from the closed position to the open position by the actuator arrangement.

The actuator arrangement may include an actuating member which may be movable transversely to move a selected one of the movable rails from the closed position to the open position. The actuating member may be positioned between the movable rails. In some embodiments, each movable rail includes a converging rail section which converges between a fixed end and a constriction and the wing rail section diverges from the constriction on each side of the fixed crossing nose towards a free end. The actuating member may be positioned between the converging rail sections. The actuating member may be set to a neutral position out of contact with the movable rails, and in particular the converging rail sections, when the movable rails are in the closed position.

The actuating member may include a longitudinally extending contoured upper surface which may have ramp sections at longitudinally opposite ends thereof. The ramp sections advantageously help to guide and may possibly help to re-rail the wheels of rolling stock passing through the railway track junction in the extremely unlikely event that the movable rails, and hence the wing rail sections, are incorrectly set for the desired route.

The actuator arrangement may include a controllable drive mechanism which is selectively operable to transversely move the actuating member. The actuating member does not cooperate with the movable rails when they are in the closed position and can be moved into contact with only one of the movable rails at a time depending on the route that needs to be selected through the railway track crossing. The controllable drive mechanism may be backdrivable and may include a plurality of independent actuator drives, for example three actuator drives. The use of a plurality of independent actuator drives provides the required degree of redundancy.

Each wing rail section typically includes a flared section at its free end which is spaced from the crossing nose when the movable rail is in the closed position. This ensures that each wing rail section, and hence each movable rail, can be moved transversely by the wheel flanges of rolling stock executing a trailing-point movement in the converging direction of the rails forming the fixed crossing nose. As a result, the railway track crossing does not present a derailment risk to rolling stock executing such a movement even if the position of the movable rails, and hence the wing rail sections, is incorrectly set for the desired route, for example due to failure of the actuator arrangement.

DETAILED DESCRIPTION OF EMBODIMENTS

Embodiments of the present disclosure will now be described by way of example only and with reference to the accompanying drawings.

Figure 1:
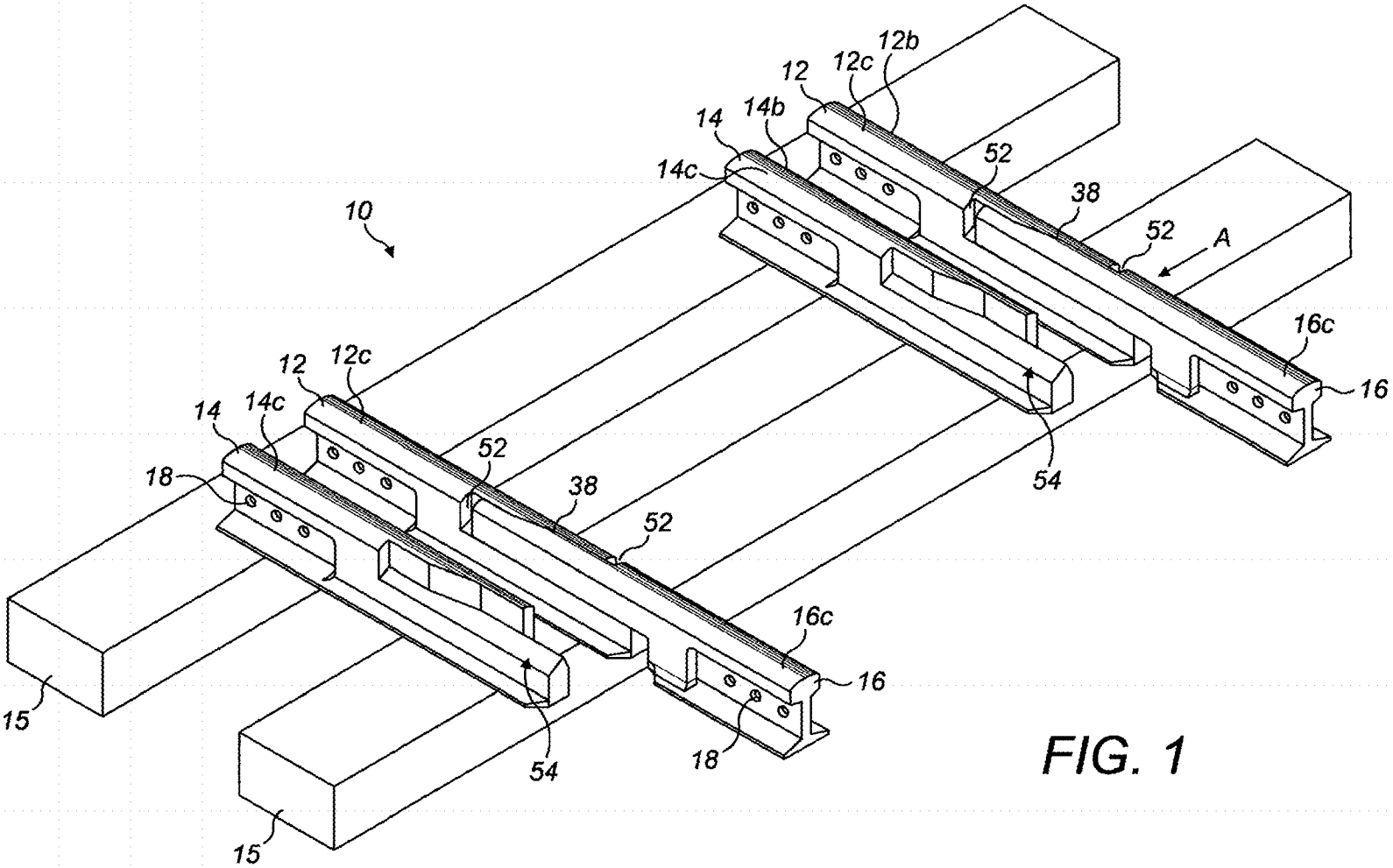
FIG. 1 is a diagrammatic perspective view of a railway points arrangement according to the present disclosure comprising switch rails and stock rails.
Figure 2:
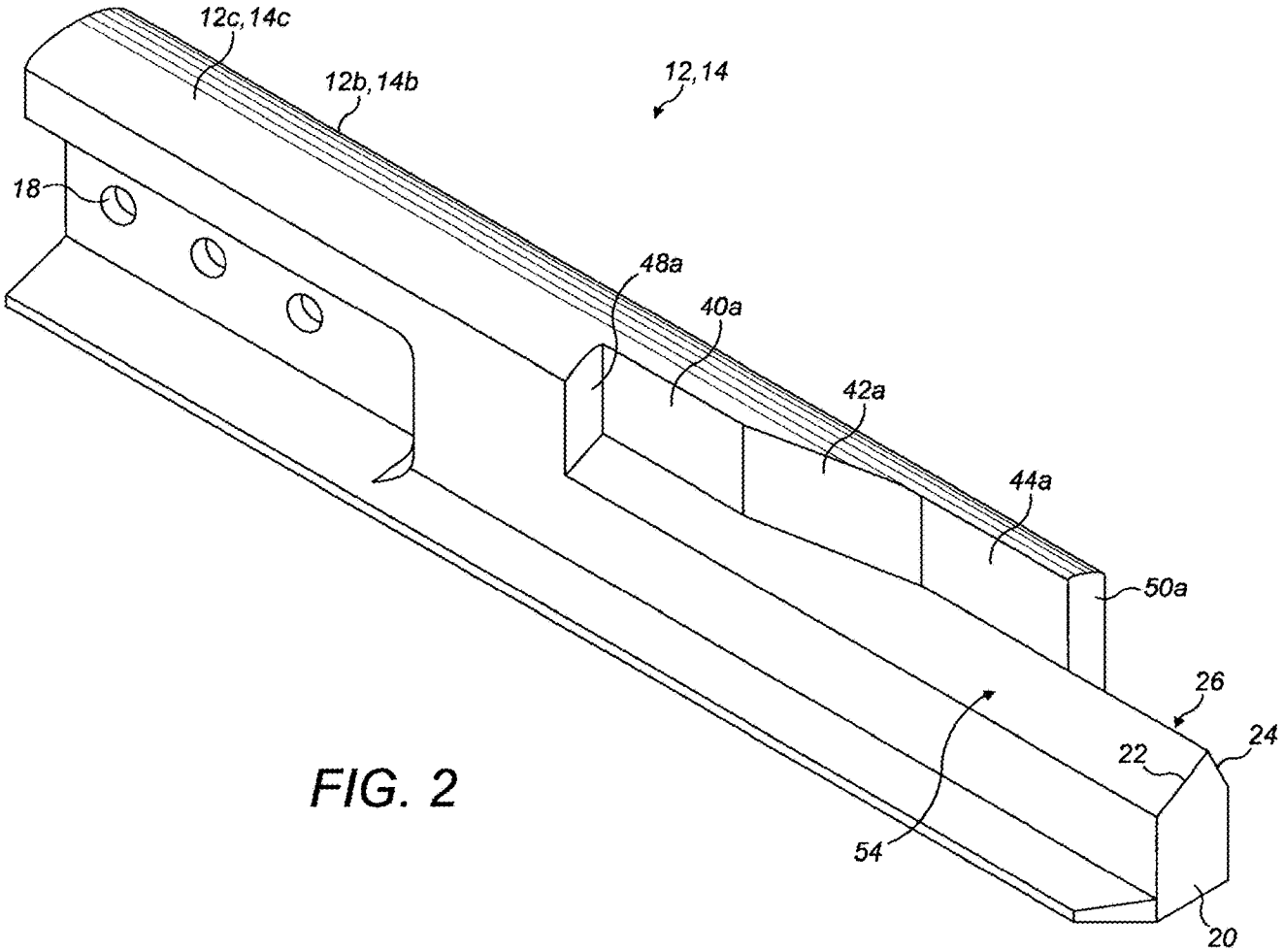
FIG. 2 is an enlarged diagrammatic perspective view of one of the stock rails shown in FIG. 1.
Figure 3:
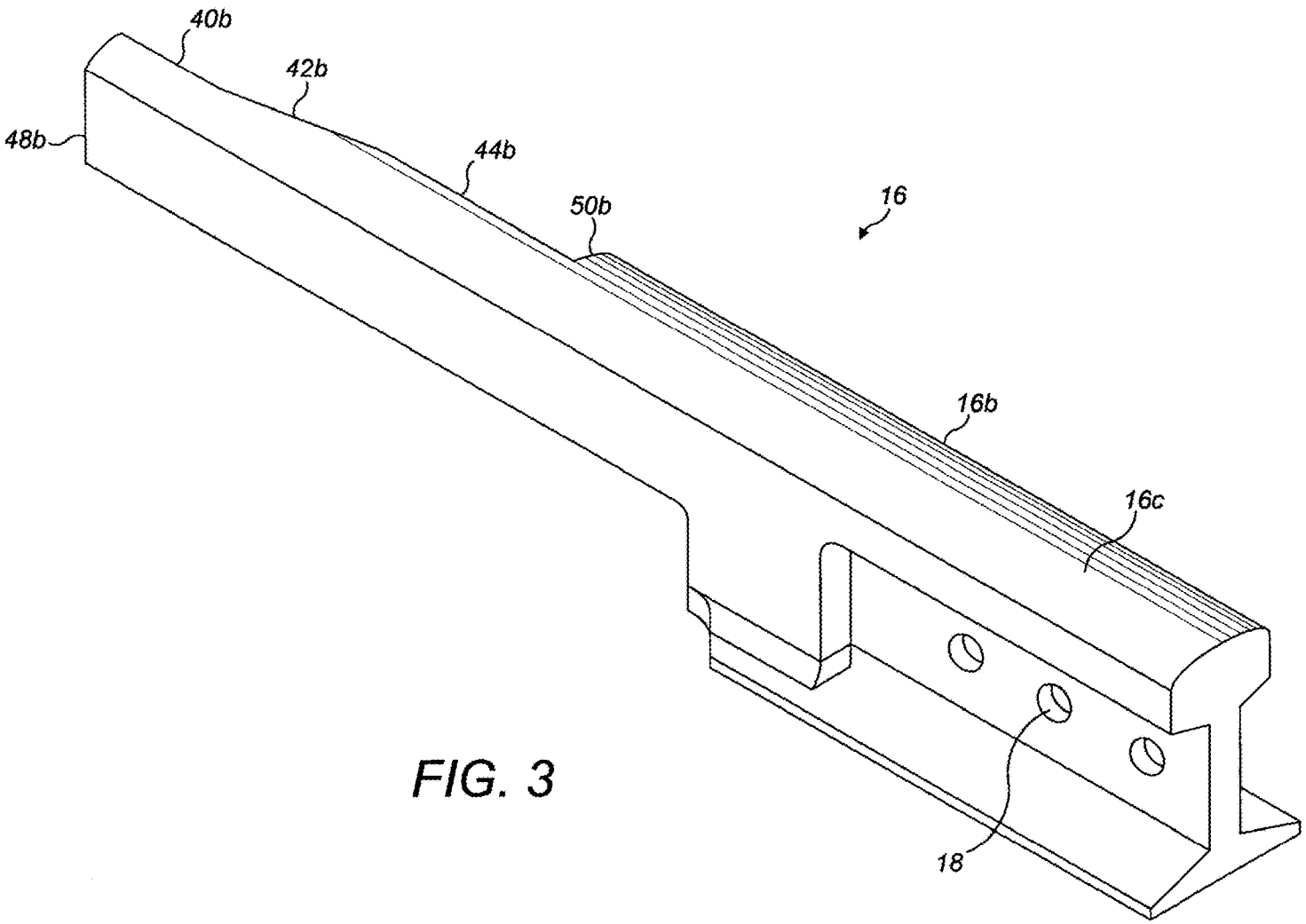
FIG. 3 is an enlarged diagrammatic perspective view of one of the switch rails shown in FIG. 1.
Figure 4:
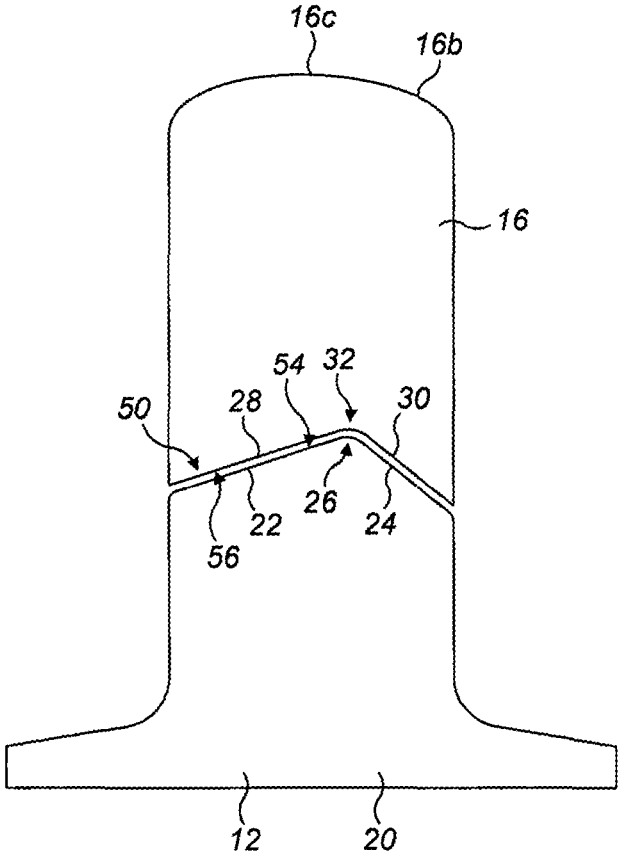
FIG. 4 is a diagrammatic cross-sectional view of the regional labelled 'A' in FIG. 1 showing one possible form of mating profile between the switch rail and the stock rail.

FIG. 1 illustrates a railway points arrangement 10 for a railway track junction which enables different routes to be selected through the junction. The points arrangement 10 comprises first and second pairs of longitudinally-extending, parallel-spaced static stock rails 12, 14 mounted on fixed supports 15 in the form of sleepers or bearers. The stock rails 12, 14 have running surfaces 12*c*, 14*c*. The first pair of stock rails 12 defines a first route, for example a straight route. The second pair of stock rails 14 defines a second route, for example a turnout route.

The points arrangement 10 also includes a pair of longitudinally-extending, parallel-spaced switch rails 16 having running surfaces 16*c*. In FIG. 1, the switch rails 16 are shown in a first transverse position in which they are aligned with the first pair of stock rails 12 and have coplanar running surfaces 16*c*, 12*c* thus enabling rolling stock to follow the first route through the railway track junction. As will be explained in further detail below, the switch rails 16 can be moved between the illustrated first transverse position and a second transverse position in which they are aligned with the second pair of stock rails 14 and have coplanar running surfaces 16*c*, 14*c* thus enabling rolling stock to follow the second route through the railway track junction.

Although not illustrated in FIG. 1, it will be appreciated that the stock rails 12, 14 and the switch rails 16 are secured to plain line rails which define the respective route either side of the railway track junction, for example the straight route and the turnout route. The stock rails 12, 14 and switch rails 16 could, for example, be secured to the plain line rails by suitable fastenings which are passed through openings 18 provided in a web section of each rail 12, 14, 16 and which engage in corresponding openings in a fish plate arrangement that is also secured to the plain line rails. Alternatively, the stock rails 12, 14 and switch rails 16 could be secured to the plain line rails by welding, in which case openings 18 do not need to be provided in the web section.

Referring now to FIGS. 1 to 4, the switch rails 16 cooperate with the stock rails 12, 14 when the switch rails 16 are in the first position (shown in FIG. 1) and the second position (not shown). In particular, the switch rails 16 and stock rails 12, 14 are shaped to define a mating profile 50 (see FIG. 4) which aligns the switch rails 16 with the stock rails 12, 14 and prevents the switch rails 16 from moving transversely, in the horizontal direction, relative to the stock rails 12, 14. The mating profile 50 is formed by an upper surface 54 of the stock rails 12, 14 and a lower surface 56 of the switch rails 16 and the particular arrangement and geometry of the mating profile 50, a preferred embodiment of which will be explained in further detail below with respect to one of the switch rails 16 and stock rails 12, acts as a passive self-alignment and locking feature which ensures that the switch rails 16 and the stock rails 12, 14 are always accurately aligned and locked transversely when the switch rails 16 are in either the first position or the second position.

The stock rail 12, 14 includes a base portion 20 having upwardly sloped converging surfaces 22, 24, acting as the upper surface 54, which define an upwardly extending convex profile section 26 extending longitudinally along at least part of the stock rail 12. Similarly, the switch rail 16 includes a concave profile section 32 defined by upwardly sloped converging surfaces 28, 30 which act as the lower surface 56. The convex profile section 26 is accommodated in the concave profile section 32 when the switch rails 16 are in the first and second positions and the switch rail 16 is thus constrained against movement in the transverse horizontal direction. In the illustrated embodiment, the convex profile section 26 and the concave profile section 32 form an inverted generally V-section profile 50. Other configurations, such as an inverted generally U-section profile, are however possible.

In order to move the switch rails 16 between the first and second positions, an actuator arrangement (not shown) is used to raise the switch rails 16 by at least a distance which is sufficient to disengage the convex profile section 26 from the concave profile section 32. The actuator arrangement transversely and vertically moves the switch rails 16 to a position in which they are transversely and vertically aligned with either the first pair of stock rails 12 or the second pair of stock rails 14 depending on the desired route, the switch rails 16 being lowered to engage the convex profile section 26 in the concave profile section 32. Any suitable actuator arrangement can be used to raise/lower and move the switch rails 16 transversely between the first and second positions. A particularly suitable actuator arrangement is described later in this specification with reference to FIGS. 5 to 15.

In accordance with aspects of the present disclosure, when the switch rails 16 are moved between the first and second positions, the actuator arrangement does not need to move the switch rails 16 to a position in which they are perfectly transversely aligned with the stock rails 12, 14. This is because the cooperation between the sloped mating surfaces 22, 28 and 24, 30 guides the switch rails 16 transversely and downwardly, for example about an arcuate path, into a position in which the running surfaces 16*c*, 12*c*, and 16*c*, 14*c* are coplanar and the switch rails 16 and stock rails 12, 14 are transversely aligned. The mating surfaces 22, 28 and 24, 30 thus ensure that the switch rails 16 are always in proper alignment with the stock rails 12, 14 when the switch rails 16 are in the first or second position.

In order to allow a gradual transfer of rolling forces between the running surface 16*c* (in particular the running edges 16*b*) of the switch rails 16 and the running surfaces 12*c*, 14*c* (in particular the running edges 12*b*, 14*b*) of the stock rails 12, 14, the switch rails 16 and stock rails 12, 14 are shaped to provide a mitred connection 38. As can be clearly seen in FIG. 1, the mitred connection 38 provides a continuous and smooth running edge surface for rolling stock passing the railway track junction.

In the illustrated embodiment, the mitred connection 38 is defined by cooperating pairs of substantially vertical faces 40*a*, 40*b*, 42*a*, 42*b* and 44*a*, 44*b* which may also help to transversely align the switch rails 16 and the stock rails 12, 14. Any suitable geometry can, however, be adopted to form the mitred connection.

The stock rails 12, 14 and the switch rails 16 have pairs of facing end surfaces 48*a*, 48*b* and 50*a*, 50*b*. The respective pairs of facing end surfaces 48*a*, 48*b* and 50*a*, 50*b* are spaced from each other when the switch rails 16 are in the first and second positions to define expansion gaps 52 which are best seen in FIG. 1. These gaps 52 ensure that if there is longitudinal thermal expansion of the stock rails 12, 14 and/or the switch rails 16, the ends of the switch rails 16 do not become jammed or fouled against the ends of the stock rails 12, 14.

Figure 5:
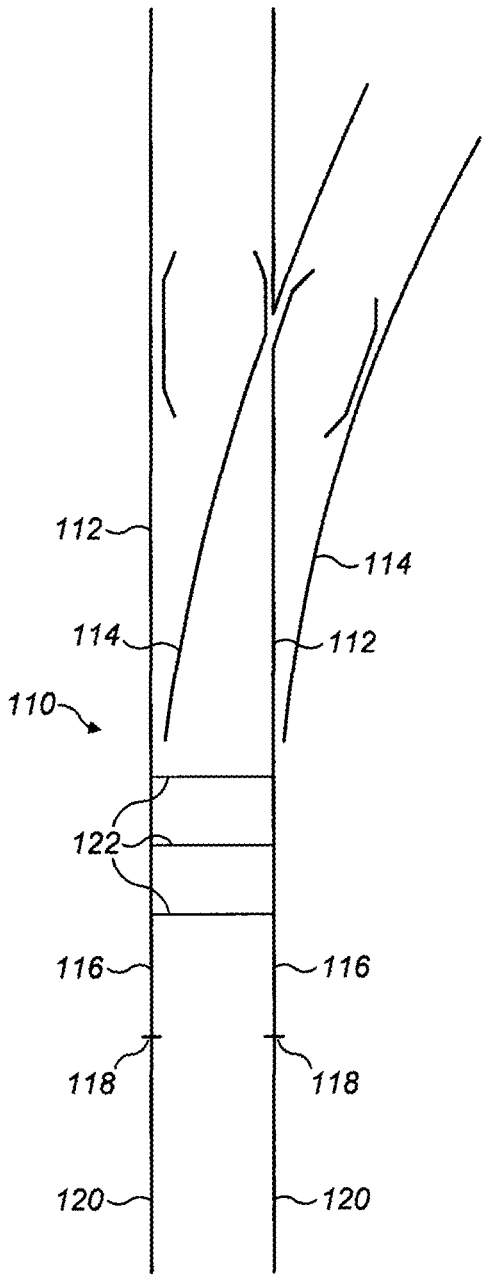
FIG. 5 is a diagrammatic plan view of one possible form of points arrangement in the form of a stub switch and including a plurality of points operating apparatus according to the present disclosure.

FIG. 5 illustrates a railway points arrangement 110 for a railway track junction which enables different routes to be selected through the junction. The illustrated points arrangement 110 takes the form of a conventional stub switch and comprises first and second pairs of longitudinally-extending, parallel-spaced static stock rails 112, 114 mounted on fixed supports in the form of sleepers or bearers (not shown). The first pair of stock rails 112 defines a first route, in the illustrated arrangement straight route. The second pair of stock rails 114 defines a second route, in the illustrated arrangement a right turnout route. Although not shown in FIG. 5, one or more further pairs of stock rails could be provided to define further diverging routes. For example, a pair of stock rails could be provided which define a third route in the form of a left turnout route.

The points arrangement 110 comprises a pair of longitudinally-extending, parallel-spaced switch rails 116 which can bend transversely about a generally fixed end 118 where the switch rails 116 are secured to plain line rails 120. In FIG. 5, the switch rails 116 are shown in a first position with the free ends of the switch rails 116 aligned with the ends of the first pair of stock rails 112, thus enabling rolling stock to follow the first (straight) route through the railway track junction. The switch rails 116 can be moved between the illustrated first position and a second position in which the free ends of the switch rails 116 are aligned with the ends of the second pair of stock rails 114, thus enabling rolling stock to follow the second (right turnout) route through the railway track junction. Similarly, the switch rails 116 can be moved to other positions in which the free ends of the switch rails 112 are aligned with the ends of other pairs of stock rails thus enabling rolling stock to follow other diverging routes through the railway track junction, such as the third (left turnout) route mentioned above but not illustrated.

In order to move the switch rails 116 between different positions, for example between the first and second positions, and to ensure that the switch rails 116 are properly aligned with the first and second pairs of stock rails 112, 114 when they are in the first and second positions, a plurality of points operating apparatus 122 is provided. As shown in FIG. 5, it is preferable that the points operating apparatus 122 are provided at longitudinally spaced positions along the switch rails 116 to ensure that the switch rails 116 are adequately supported and aligned along their length and to ensure that the necessary degree of redundancy is provided. Redundancy is desirable so that the points arrangement 110 can continue to operate in the event of failure of, for example, one of the points operating apparatus 122. Although three points operating apparatus 122 are shown in FIG. 5, this is illustrative only and any suitable number of points operating apparatus can be provided.

Figure 6:
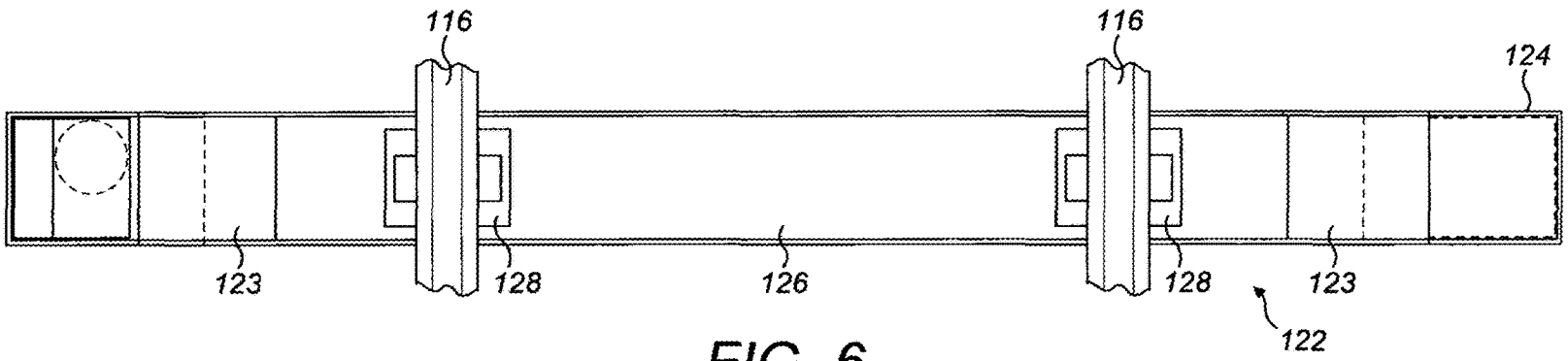
FIG. 6 is a detailed diagrammatic plan view of the points operating apparatus.
Figure 7:
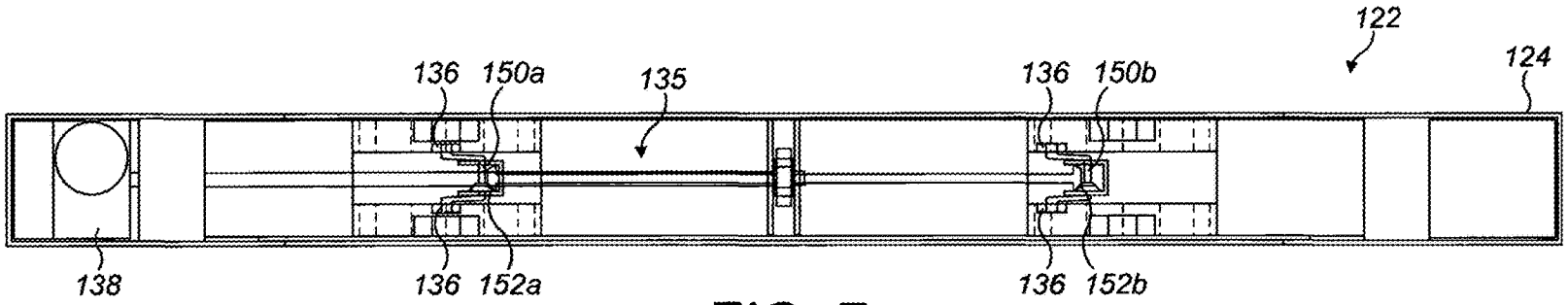
FIG. 7 is a diagrammatic view similar to FIG. 6 with the switch rails and support member for the switch rails omitted.
Figure 8:
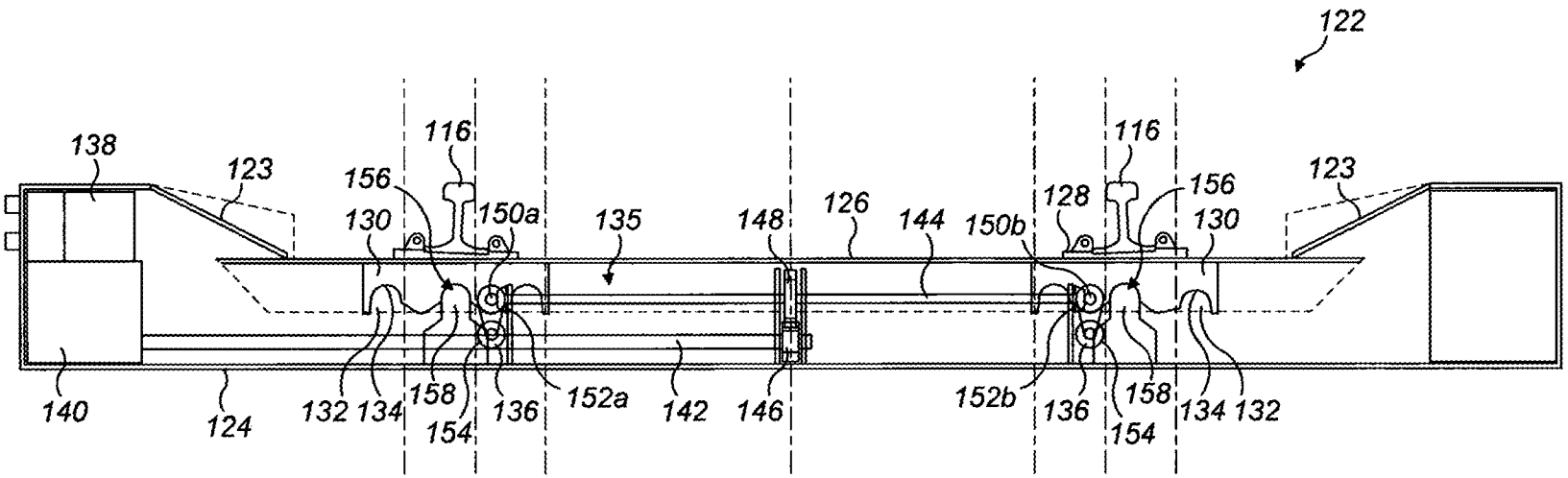
FIG. 8 is a diagrammatic cross-sectional side view of the points operating apparatus of FIGS. 6 and 7 in a configuration in which it locates the switch rails in a first position.

Referring now to FIGS. 6 to 8, the points operating apparatus 122 comprises a housing 124 having a support member 126 in the form of a bearer which is positioned underneath the switch rails 116 and which forms the top of the housing 124. The switch rails 116 are removably secured, for example by suitable mounts 128, in a predetermined spaced relationship to the upper surface of the support member 126 and the support member 126 thus supports and moves the switch rails 116. The support member 126 has two pairs of longitudinally spaced plate members 130 on its lower surface. Each pair of plate members 130 is located at a position substantially beneath the switch rails 116 and has three transversely spaced and downward facing recesses 132. The recesses 132 each have a bearing surface 134 which has a substantially semi-circular or inverted U-shaped profile.

The points operating apparatus 122 comprises an actuator arrangement 135 which moves the support member 126, and hence the switch rails 116, between different positions, for example first, second and third positions, to select different routes through the railway track junction. Rather than moving the switch rails 116 in a transverse horizontal direction as is conventional in the prior art, the actuator arrangement 135 moves the support member 126, and hence the free ends of the switch rails 116, transversely and vertically about a semi-circular arc between different positions so that the free ends of the switch rails 116 are raised and lowered relative to the stock rails 112, 114 during the transverse switching movement. In practice, this transverse and vertical movement of the free ends of the switch rails 116 is achieved by bending the switch rails 116.

The actuator arrangement 135 comprises a drivetrain for rotating an actuating member in the form of a cam member 136 which can be selectively engaged in the recesses 132 to move the support member 126, and hence the switch rails 116, about the semi-circular arc between the first and second positions. The drivetrain comprises an electric motor 138 which is connected, by a backdrivable gearbox 140, to a primary driveshaft 142. Rotational motion is transmitted from the primary driveshaft 142 to a final driveshaft 144 by spur gears 146, 148 mounted respectively on each shaft 142, 144. One of the spur gears 146, 148 may include a slip clutch (not shown) having a predetermined slip torque. Rotational motion is transmitted from the final driveshaft 144 to cam shafts 150*a*, 150*b* by a crown and pinion gear arrangement 152*a*, 152*b* located at each end of the final driveshaft 144. Each cam shaft 150*a*, 150*b* carries two longitudinally spaced cam members 136. Each cam member 136 has a lobe which provides a bearing surface 154 which is complementary to the bearing surface 134 of each recess 132 and which cooperates with the bearing surface 134 of each recess 132 when the cam members 136 are engaged in the recesses 132.

The points operating apparatus 122 further comprises a locking arrangement 156 which securely retains the support member 126, and hence the switch rails 116, in a selected transverse position (such as the first, second or third position) and prevents movement of the support member 126 from the selected position in a transverse horizontal direction. Movement of the support member 126, and hence the switch rails 116, from the selected position can be effected only when the support member 126 is urged to move by the actuator arrangement about the aforementioned semi-circular arc.

The locking arrangement 156 comprises two pairs of longitudinally spaced locking projections 158 which are fixed to, and extend upwardly from, a base of the housing 124. Each locking projection 158 has a bearing surface 160 with a substantially semi-circular or inverted U-shaped profile which is complementary to the bearing surfaces 134 of the recesses 132.

Figure 12:
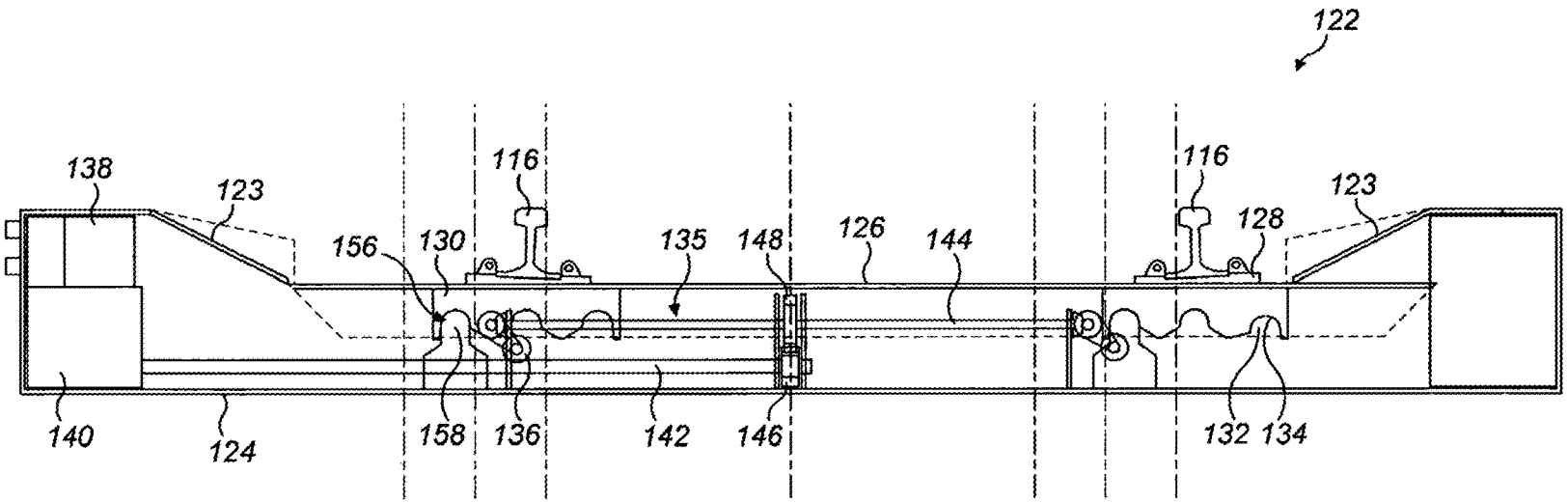

FIG. 8 shows the points operating apparatus 122 in a first configuration in which the switch rails 116 are in a first, central, position aligned, for example, with the first pair of stock rails 112 illustrated in FIG. 5 to select the straight route. FIG. 12 shows the points operating apparatus 122 in a second configuration in which the switch rails 116 are in a second position aligned, for example, with the second pair of stock rails 114 illustrated in FIG. 5 to select the right turnout route. It will be noted that when the points operating apparatus 122 is in either of these configurations or indeed similar configurations in with the switch rails 116 are set for any given route, the cam members 136 are disengaged from the recesses 132 whereas the locking projections 158 are fully engaged in the recesses 132. It will, therefore, be apparent that the actuator arrangement 135, in particular the cam members 136, plays no part in locking the support member 126, and hence the switch rails 116, in a selected position. This locking is achieved solely by virtue of the cooperation between the locking projections 158 and the recesses 132.

The operation of the points operating apparatus 122 will now be explained with reference to FIGS. 8 to 12 when the switch rails 116 are moved between the first and second positions.

Figure 9:
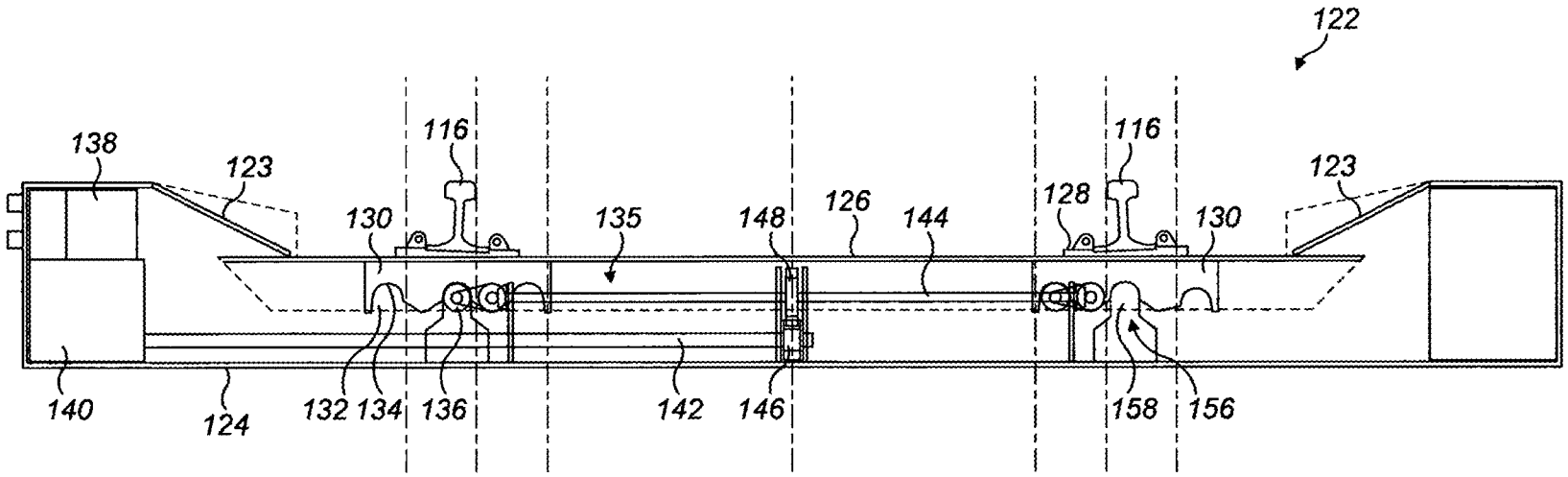
FIGS. 9 to 12 illustrate the operation of the points operating apparatus as it moves the switch rails from the first position shown in FIG. 8 to a second position shown in FIG. 12.
Figure 10:
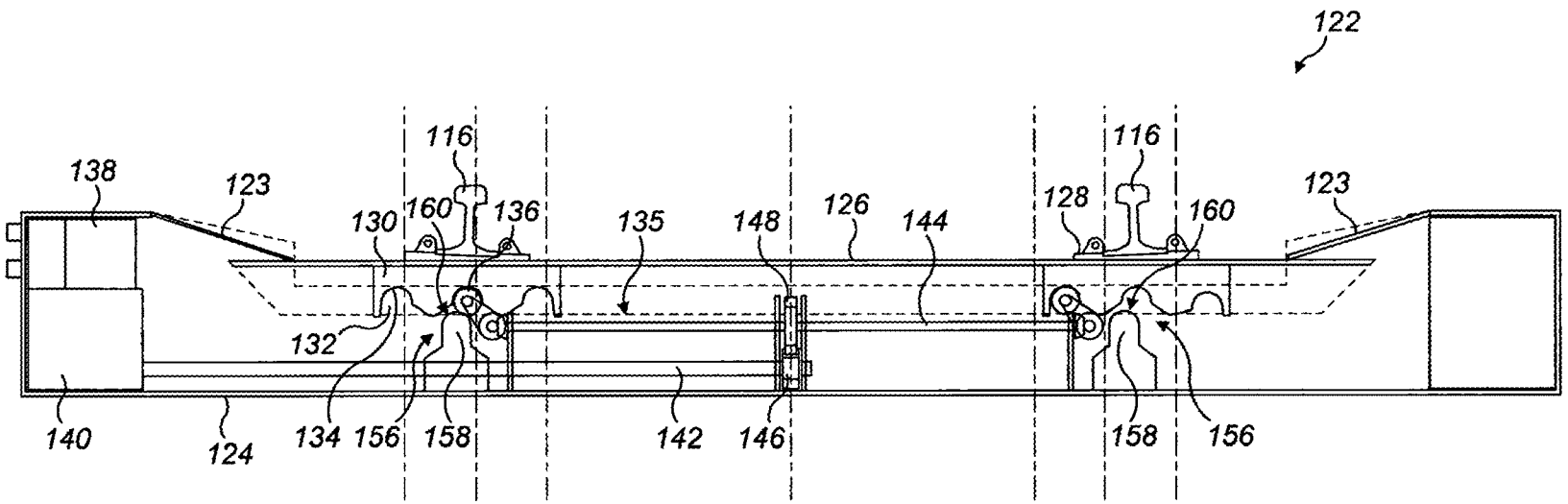
Figure 11:
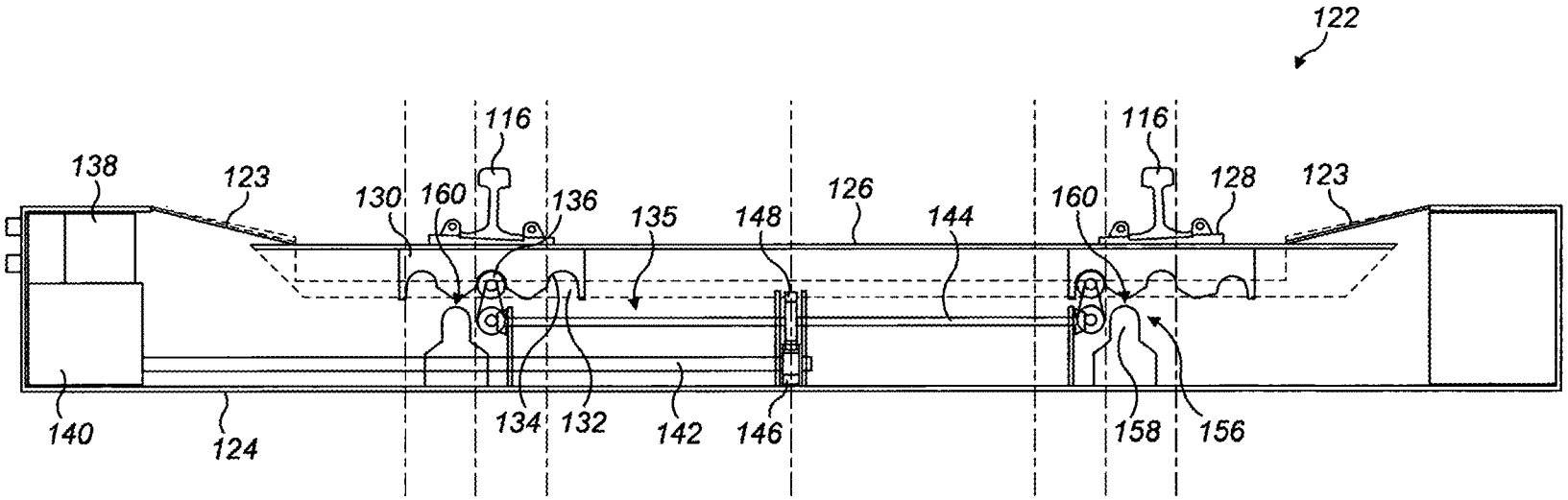

The electric motor 138 is operated to rotate the primary driveshaft 142 via the gearbox 140. This in turn rotates the final driveshaft 144, via the spur gears 146, 148, thereby rotating the cam shafts 150*a*, 150*b* via the crown and pinion gear arrangements 152*a*, 152*b*. The cam members 136 are thus rotated in the clockwise direction into a position in which they engage the corresponding recesses 132 in the plate members 130 as shown in FIG. 9. Continued clockwise rotation of the cam members 136 moves the support member 126, and hence the switch rails 116, upwardly and transversely towards the right to commence the semi-circular motion as shown in FIG. 10. During this semi-circular motion, the locking projections 158 are progressively disengaged from the recesses 132, the cooperation between the bearing surfaces 134 and 160 facilitating this disengagement. Further clockwise rotation of the cam members 136 continues the semi-circular motion of the support member 126 and the switch rails 116, as shown in FIG. 11. Once the support member 126 has reached the position shown in FIG. 11, the inherent stiffness of the switch rails 116 (and possibly the mass of the switch rails 116 depending on their length) tends to urge them downwardly, along the semi-circular arc which is dictated by the rotational motion of the cam members 136 on the camshafts 150*a*, 150*b*. The support member 126 is, therefore, also urged downwardly along the same semi-circular arc and as the switch rails 116 approach the second position, the locking projections 158 progressively engage in the recesses 132, this engagement being facilitated by the cooperation between the bearing surfaces 134 and 160. Advantageously, the semi-circular profile of the bearing surfaces 134, 160 tends to align the support member 126 transversely as it completes its semi-circular motion and this helps to ensure that the switch rails 116 are correctly aligned with the stock rails 114 when the switch rails 116 are in the second position. As shown in FIG. 12, rotation of the cam members 136 continues until the cam members 136 are completely disengaged from the recesses 132.

Figure 13:
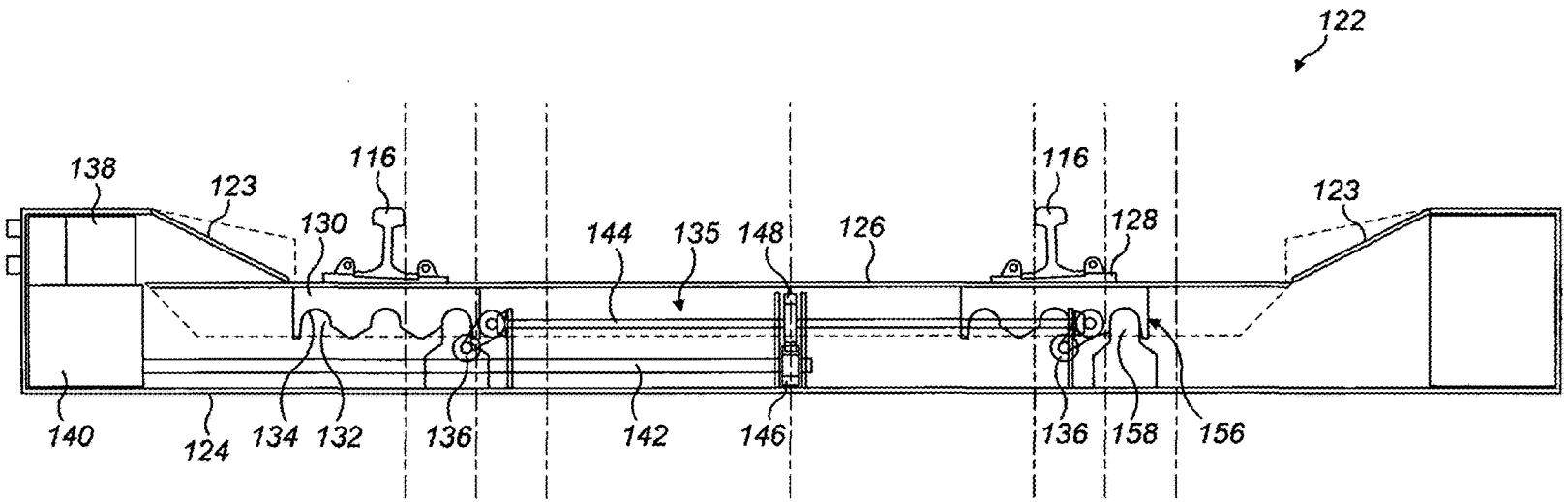
FIG. 13 is a diagrammatic cross-sectional side view of the points operating apparatus similar to FIG. 8 but in a configuration in which it locates the switch rails in a third position.

It will be understood that a different route, such as the left turnout route, can be selected in a similar manner, for example by operating the electric motor 138 to rotate the cam members 136 in the anti-clockwise direction to move the support member 126 and hence the switch rails 116 from the position shown in FIG. 8 to the position shown in FIG. 13.

It will be noted that the key components of the points operating apparatus 122 are all positioned inside the housing 124 and therefore protected from the external environment. This improves the reliability of the apparatus 122. In order to permit the support member 126 to follow the semi-circular path and at the same time maintain the sealed environment inside the housing 124, the apparatus 122 includes movable or flexible flap members 123 which can move upwardly and downwardly, as best shown in FIGS. 8 to 12, in concert with the movement of the support member 126.

Figure 14:
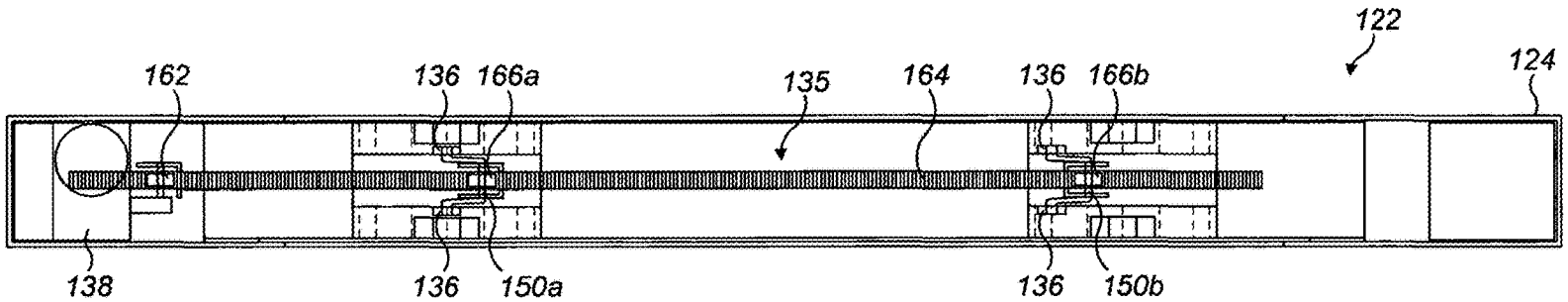
FIG. 14 is a diagrammatic plan view similar to FIG. 7 of an alternative embodiment of a points operating apparatus.
Figure 15:
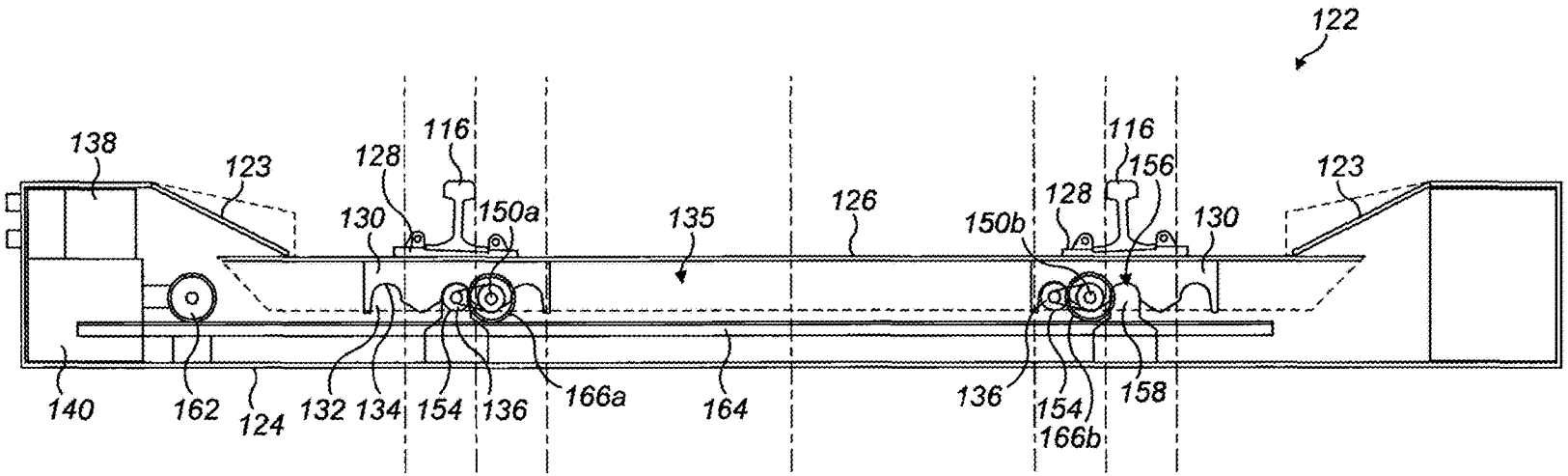
FIG. 15 is a diagrammatic cross-sectional side view of the points operating apparatus shown in FIG. 14.

FIGS. 14 and 15 illustrate an alternative embodiment of the points operating apparatus 1122 which is similar to the points operating apparatus 122 shown in FIGS. 6 to 13 and in which corresponding components are identified using corresponding reference numerals.

The points operating apparatus 1122 utilises a modified drivetrain based on a rack-and-pinion arrangement. In more detail, the electric motor 138 and gearbox 140 rotate a pinion gear 162 which cooperates with a transversely extending and transversely movable rack gear 164 to thereby move the rack gear 164. Each of the cam shafts 150*a*, 150*b* also carries a pinion gear 166*a*, 166*b* which cooperates with the rack gear 164. It will be apparent that upon movement of the rack gear 164 in the transverse direction, the pinion gears 166*a*, 166*b* are rotated thereby causing corresponding rotation of the camshafts 150*a*, 150*b* and the cam members 136. Although the points operating apparatus 1122 utilises a modified drivetrain, it will be immediately apparent that the motion of the support member 126, and hence the motion of the switch rails 116, is the same as described above with reference to FIGS. 8 to 13. Accordingly, no further explanation is needed.

The points operating apparatus 122, 1122 has been described in conjunction with a standard stub switch in which the free ends of the switch rails 116 do not cooperate with the ends of the stock rails 112, 114 when the switch rails 116 are in the first or second positions or indeed in any other position (such as a third position). In such conventional stub switches, there is no strict requirement to raise the switch rails 116 in order to effect transverse movement between different positions, such as the first, second and third positions, but this might be advantageous for the reasons mentioned earlier in this specification.

A points arrangement 10 which is based on the standard stub switch but in which the free ends of the switch rails 16 cooperate with the stock rails 12, 14 when the switch rails 16 are in different positions, set for different routes, has been described above with reference to FIGS. 1 to 4. In a preferred embodiment of the railway points arrangement 10, the free ends of the switch rails 16 have to be raised to disengage them from the stock rails 12, 14 to enable the switch rails 16 to be moved transversely between different positions, for example first, second and third positions, to select different routes. It will, therefore, be apparent that the points operating apparatus 122, 1122 described with reference to FIGS. 5 to 15 is particularly, although not exclusively, suitable for use with the railway points arrangement 10 described with reference to FIGS. 1 to 4.

It should also be noted for completeness that the points operating apparatus 122, 1122 is not exclusively intended for use with a points arrangement 110 in the form of a stub switch and that it can be used to move and lock the switch rails of a traditional points arrangement in which the switch rails are located between incoming stock rails and can move about a fixed end. In such a conventional points arrangement, the free ends of the switch rails can be moved transversely and vertically about an arc by the points operating apparatus 122, 1122 between a first position in which the free end of one of the switch rails contacts one of the incoming stock rails to select the first route and a second position in which the free end of the other switch rail contacts the other incoming stock rail to select the second route.

Figure 16:
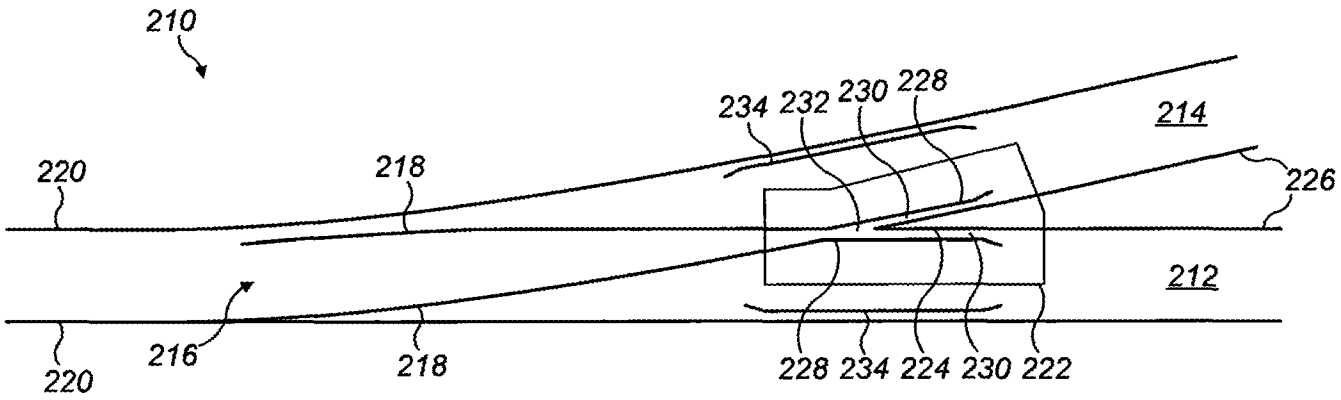
FIG. 16 is a plan view of a railway track junction including a set of railway points and a conventional "fixed" railway track crossing.

FIGS. 17 to 27 illustrate a railway track crossing 240 according to the present disclosure. The railway track crossing 240 forms part of a railway track junction 210 such as that shown in FIG. 16 in place of the fixed railway track crossing 222.

Figure 17:
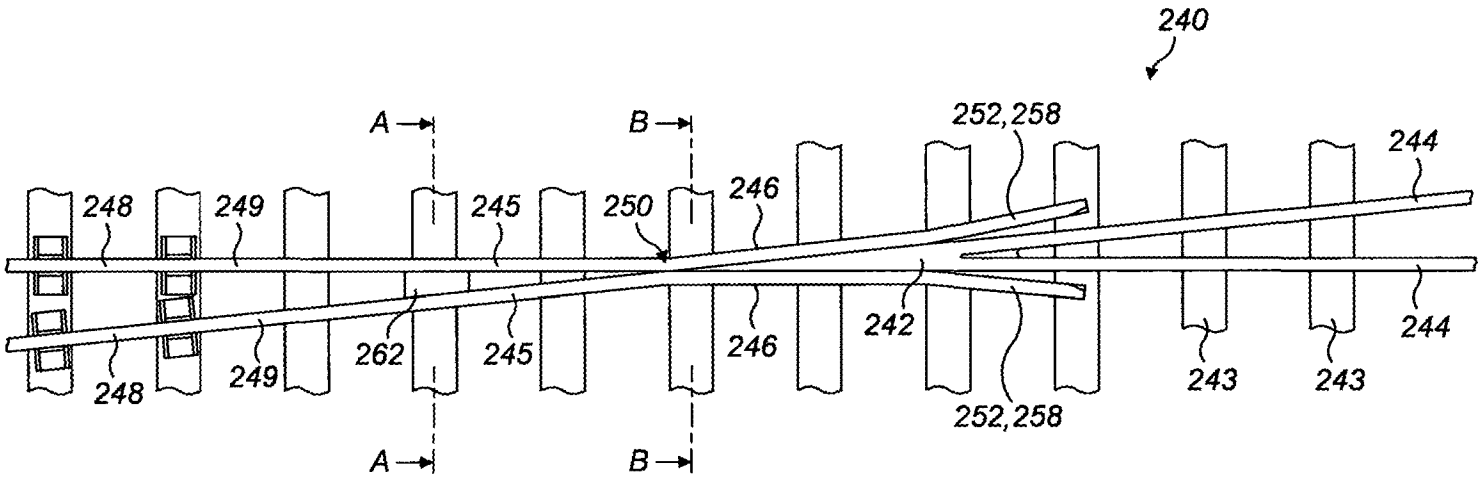
FIG. 17 is a plan view of a railway track crossing according to the present disclosure in which each of the movable rails is in a closed position.
Figure 18:
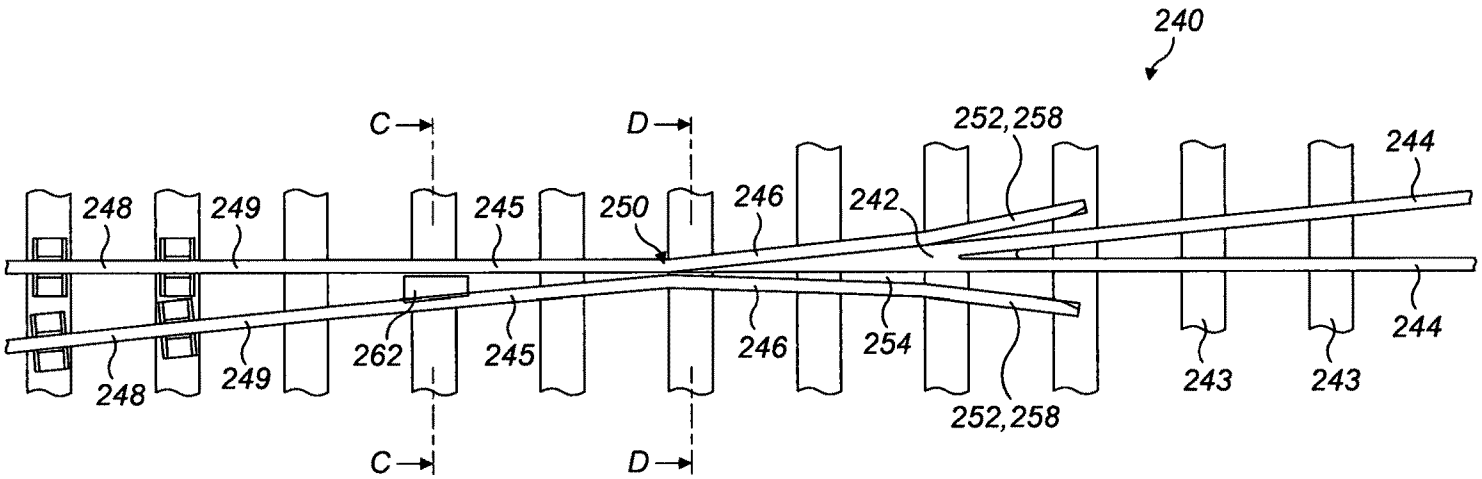
FIG. 18 is a view similar to FIG. 17 in which the railway track crossing is set for the straight route shown in FIG. 16 with one of the movable rails in an open position.
Figure 19:
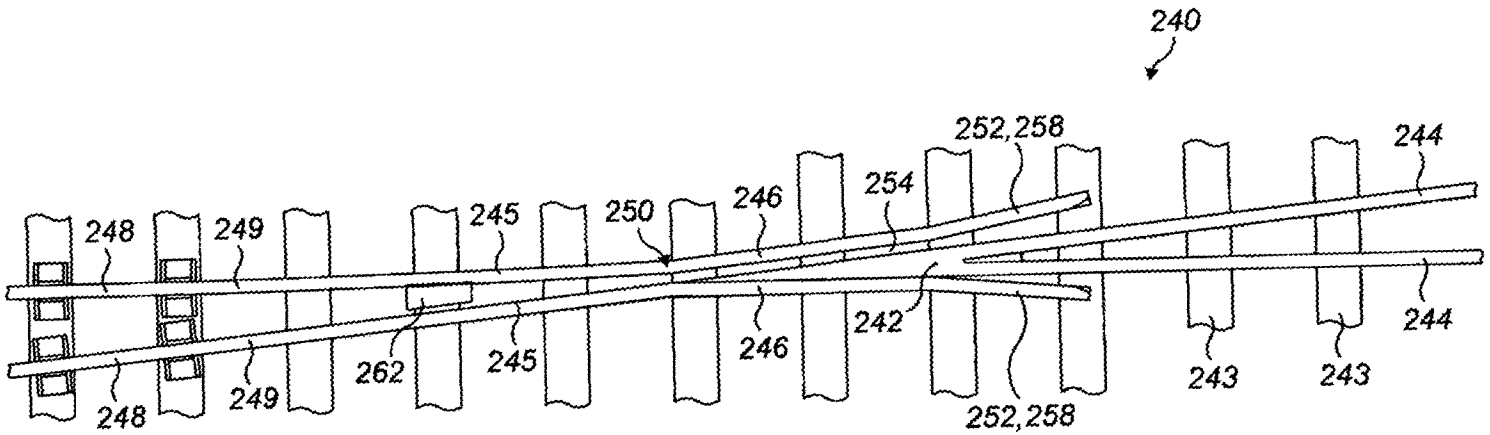
FIG. 19 is a view similar to FIGS. 17 and 18 in which the railway track crossing is set for the turnout route shown in FIG. 16 with the other of the movable rails in an open position.

Referring initially to FIGS. 17 to 19, the railway track crossing 240 includes a v-section fixed crossing nose 242, formed by a pair of diverging rails 244, and a pair of movable rails 245 each having a wing rail section 246 provided on each side of the fixed crossing nose 242. The diverging rails 244 and movable rails 245 are mounted in a conventional manner on fixed supports 243 in the form of sleepers or bearers. The movable rails 245 include converging rail sections 249 which converge from a fixed end 248 towards a constriction 250. The wing rail sections 246, which form a continuation of the converging rail sections 249, diverge from the constriction 250 on each side of the fixed crossing nose 242 towards a free end 252. Each of the movable rails 245 is independently movable between a closed position, shown in FIGS. 17, 20 and 21, in which its wing rail section 246 contacts the crossing nose 242, and an open position, shown in FIGS. 18, 19, 22, 23, 24 and 25, in which its wing rail section 246 is spaced from the crossing nose 242. When each movable rail 245 is in the open position, a groove 254 (FIGS. 18, 19 and 25) is provided between the crossing nose 242 and the wing rail section 246 to allow the passage of a wheel flange 256*a*. As can be clearly seen in FIG. 17, each wing rail section 246 includes a flared section 258 at its free end 252 which is spaced from the crossing nose 242 when the movable rail 245 is in the closed position.

An actuator arrangement 260 (see FIG. 26) is provided to move a selected one the movable rails 245 from the closed position to the open position by applying a transverse force to the selected movable rail 245. In the absence of any transverse force being applied to the movable rails 245 by the actuator arrangement 260, the movable rails 245 adopt the closed position shown in FIGS. 17 and 21 thereby placing the railway track crossing 240 in a neutral state. The actuator arrangement 260 includes an actuating member 262 located between the converging rail sections 249, at a position between the fixed ends 248 and the constriction 250.

The actuator arrangement 260 includes an actuator arm 264 which cooperates at one end with the actuating member 262 by virtue of engagement of an upwardly projecting leg 266 in a recess 268 formed in the actuating member 262. The other end of the actuator arm 264 cooperates with a trackside controllable drive mechanism (not shown), such as an actuator bank including a plurality of backdrivable independent actuator drives. The controllable drive mechanism can be operated in a conventional manner to displace the actuator arm 264, and hence the actuating member 262, transversely. The actuating member 262 can consequently be moved transversely into contact with a selected one of the movable rails 245, and in particular the converging rail sections 249, and can thereby displace the selected movable rail 245 transversely from the closed position to the open position.

Figure 20:
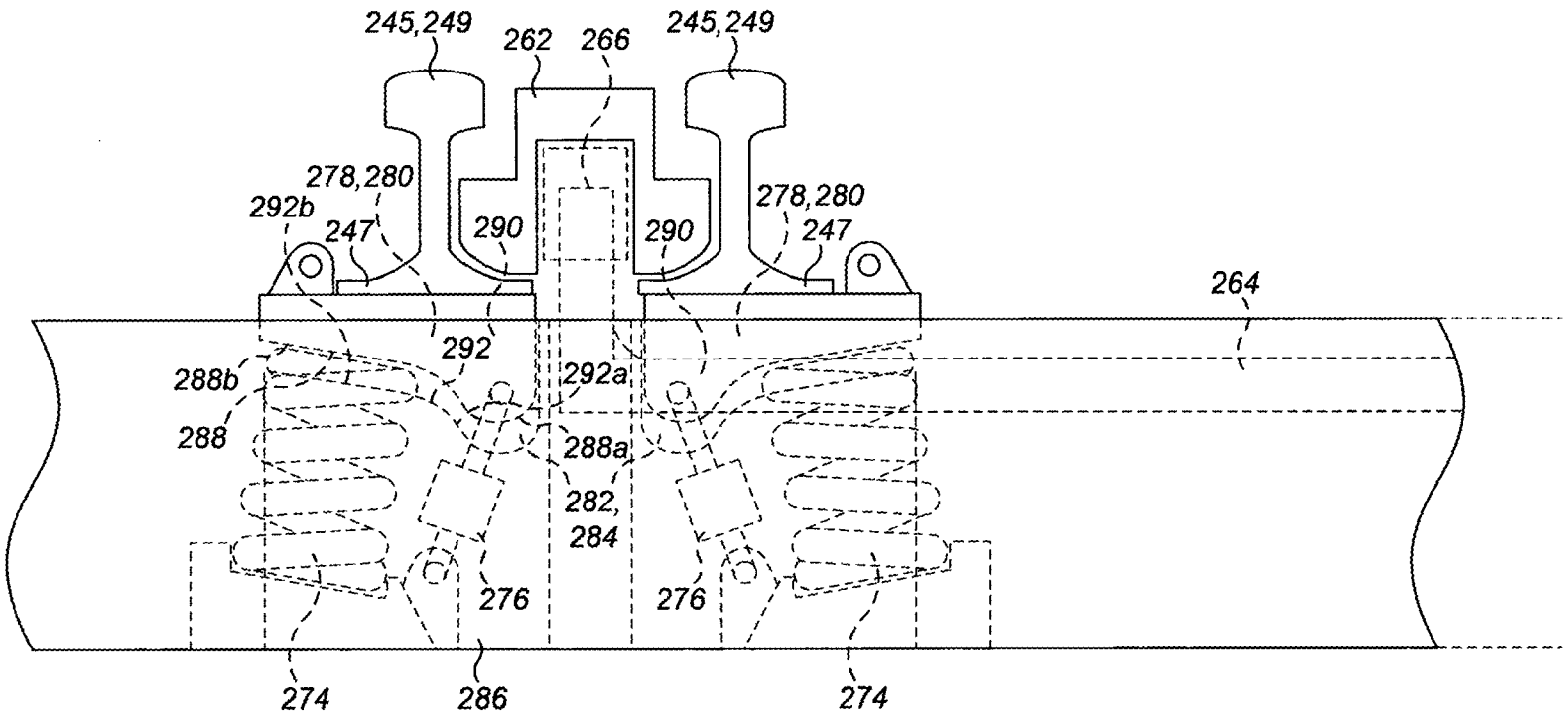
FIGS. 20 and 21 are cross-sectional views respectively along the lines A-A and B-B of FIG. 17.
Figure 21:
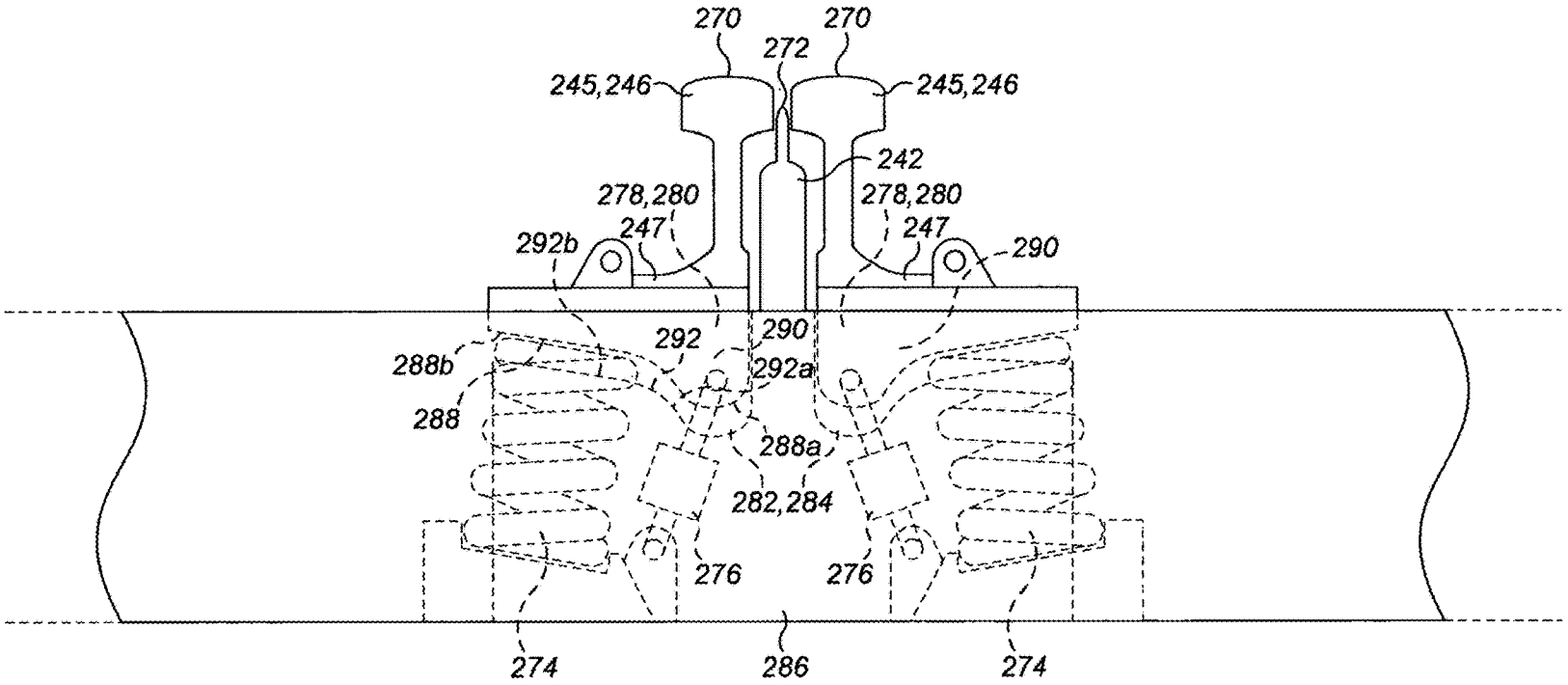
Figure 24:
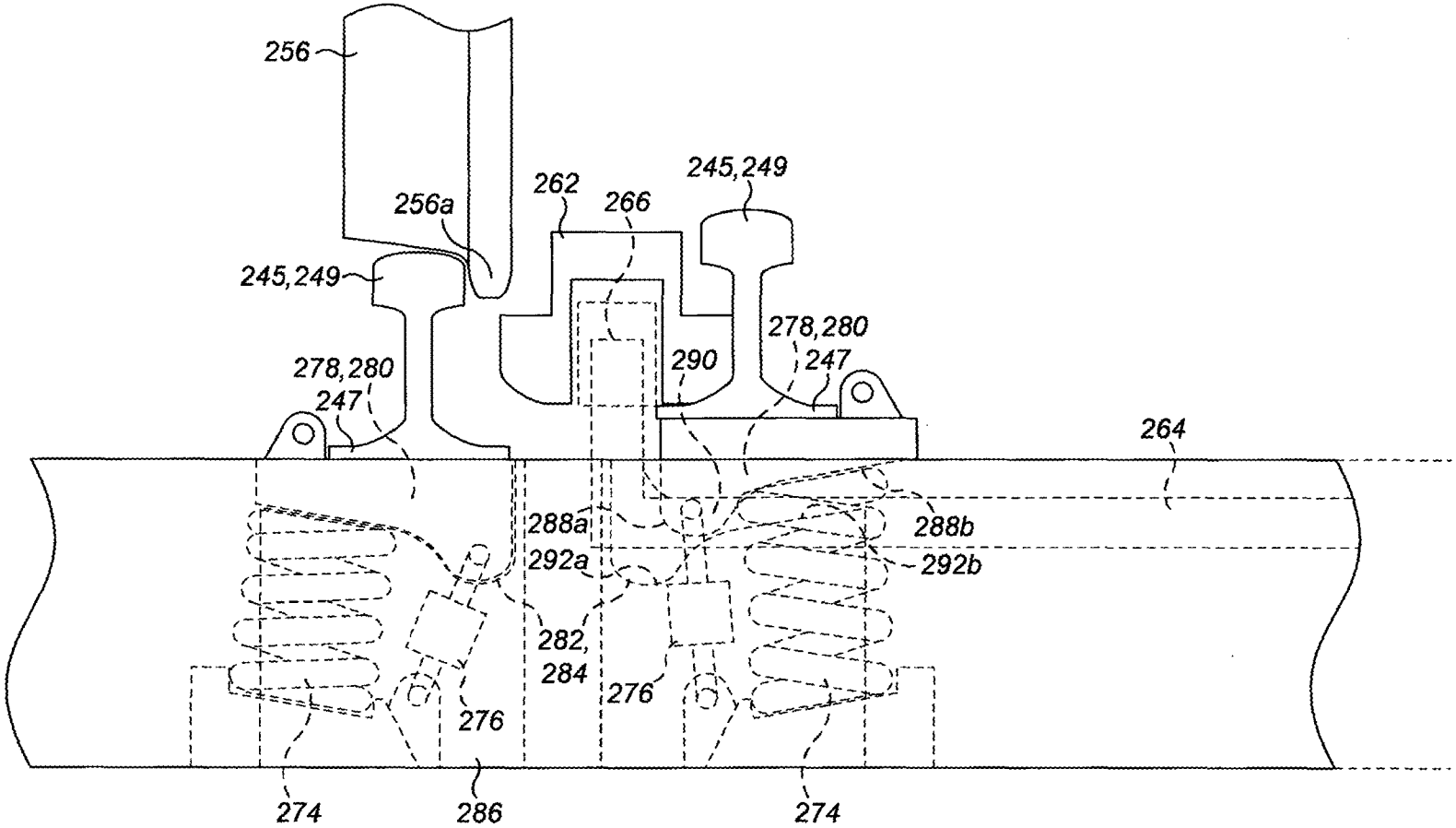
FIGS. 24 and 25 are cross-sectional views similar to FIGS. 22 and 23 showing the movable rail loaded by a wheel of passing rolling stock.
Figure 25:
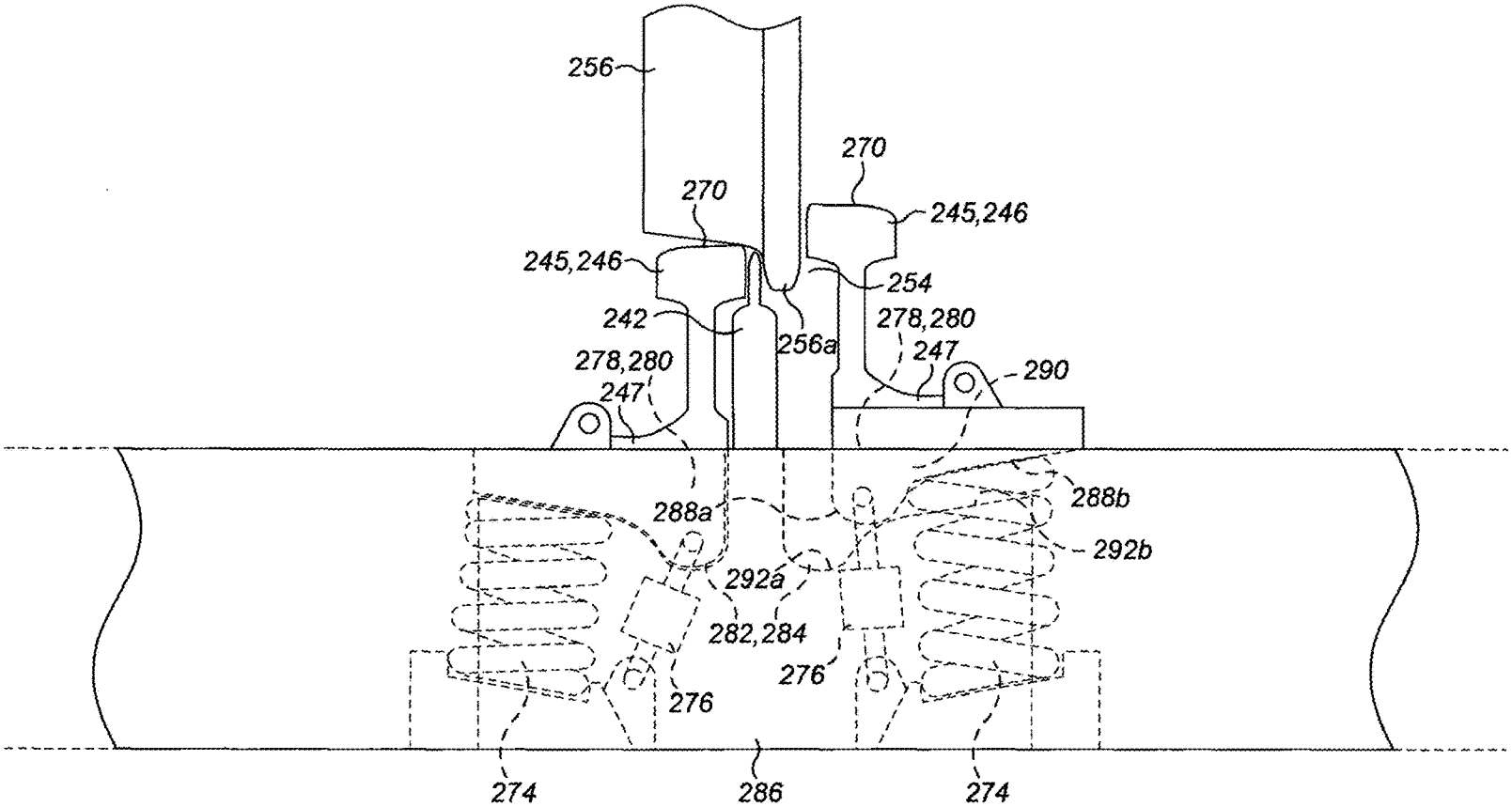
Figure 26:
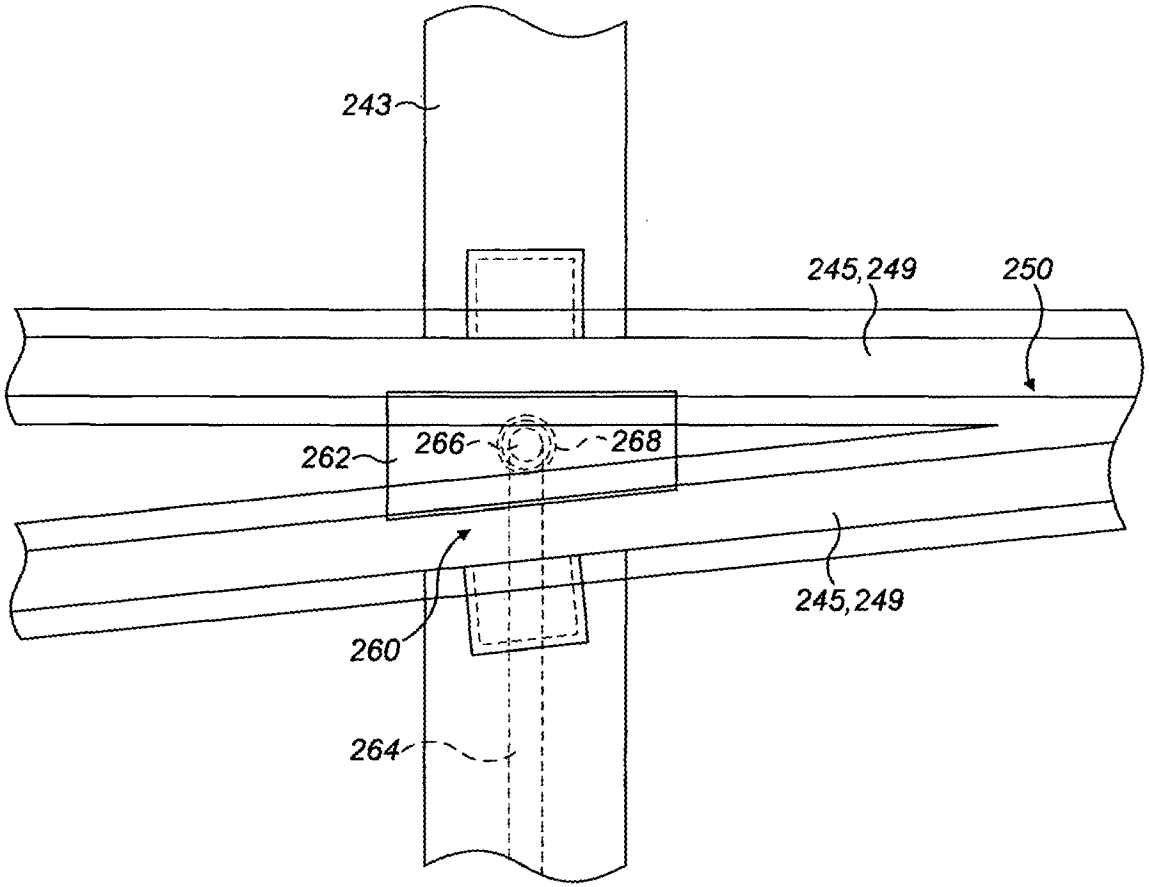
FIG. 26 is an enlarged plan view of part of an actuator arrangement.
Figure 27:
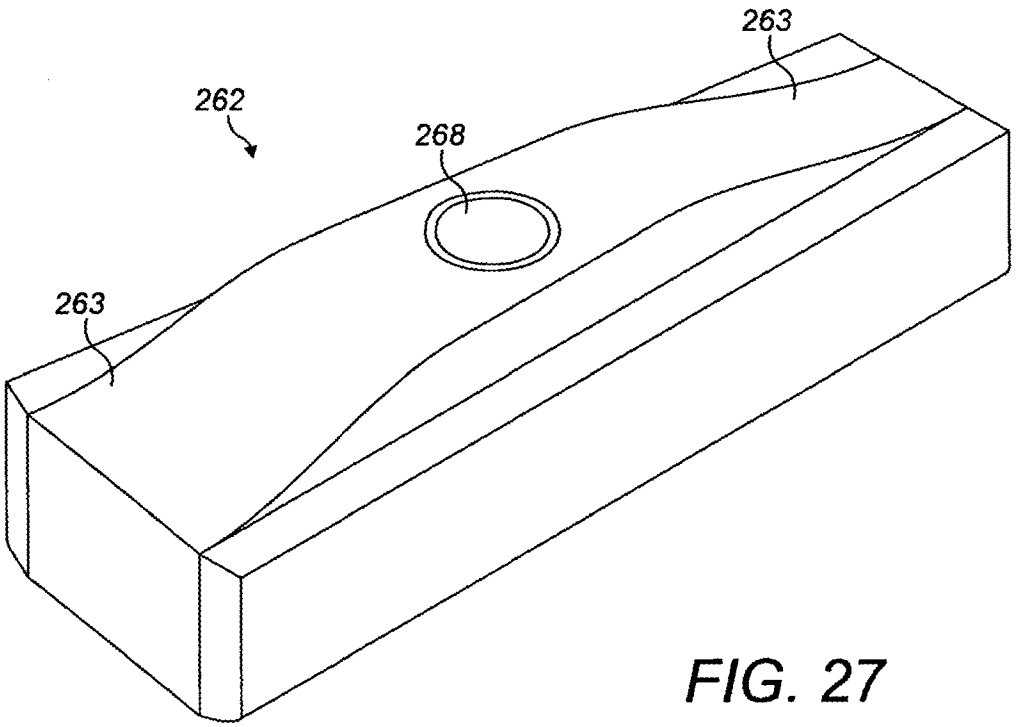
FIG. 27 is a perspective view of an actuating member.

When the movable rails 245 are in the closed position, they can move vertically between a first position, shown in FIGS. 20 and 21, and a second position, shown in FIGS. 24 and 25 (see the left movable rail 245). When the movable rails 245 are in the first position, the running surface 270 of the wing rail sections 246 is raised slightly above to the running surface 272 of the crossing nose 242. When the movable rails 245 are in the second position, the running surface 270 of the wing rail sections 246 is substantially coplanar with the running surface 272 of the crossing nose 242 thereby providing a continuous running surface for the wheels 256 of passing rolling stock.

The railway track crossing 240 includes a plurality of biasing means 274 in the form of compression springs which are spaced longitudinally along the running direction of each movable rail 245. The primary purpose of the biasing means 274 is to bias the movable rails 245 into the elevated first position shown in FIGS. 20 and 21 and to thereby prevent the movable rails 245 from moving to the second position under their own weight (i.e. from sagging). Due to the inclination of the biasing means 274 in the illustrated embodiment, it will be appreciated that the biasing means 274 also help to bias the movable rails 245 into the closed position, such that the wing rail sections 246 are in contact with the crossing nose 242. Referring to FIGS. 24 and 25, it will be seen that when a selected one of the movable rails 245 is in the closed position and is loaded by the wheels 256 of rolling stock passing through the railway track crossing 240 (the left movable rail in FIGS. 24 and 25), the load applied to the movable rail 245 displaces it from the elevated first position to the second position thereby compressing the biasing means 274. After rolling stock has passed through the railway track crossing 240, the movable rail 245 is biased upwardly to the elevated first position by the biasing means 274.

The railway track crossing includes a plurality of dampers 276 which, like the biasing means 274, are spaced longitudinally along the running direction of each movable rail 245. The dampers 276 retard the movement of the movable rails 245 in the upward direction, from the second position to the first position, and may also retard movement of the movable rails 245 from the open position to the closed position if the movable rails 245, and hence the wing rail sections 246, are incorrectly positioned for the desired route, as will be explained in further detail below.

Each movable rail 245 includes a first mating feature 278 in the form of a convex profile section 280 which extends longitudinally along the running direction of each movable rail 245. The convex profile section 280 projects downwardly from a lower flange 247 of each movable rail 245. The railway track crossing 210 also includes a second mating feature 282 in the form of an upwardly opening concave profile section 284 which extends longitudinally along the running direction of each movable rail 245. In the illustrated embodiment, a longitudinally extending locking element 286 is positioned beneath the movable rails 245 and the concave profile sections 284 are formed at transversely spaced positions in the locking element 286. As can be clearly seen in FIGS. 24 and 25, when the movable rail 245 which is in the closed position is loaded by the wheels 256 of rolling stock passing through the railway track crossing 240 so that it is moved to the second position, the convex profile section 280 engages the concave profile section 284. This engagement prevents any transverse movement of the movable rail 245, and hence the wing rail section 246, and ensures that the movable rail 245 is locked in the closed position, with the wing rail section 246 in contact with the crossing nose 242, whilst it is loaded by the wheels 256 of passing rolling stock.

Each convex profile section 280 includes a bearing surface 288 having a substantially semi-circular curved surface portion 288*a* provided by a shoulder 290 and a substantially linear surface portion 288*b* which is inclined upwardly away from the crossing nose 242 in the transverse direction. Each concave profile section 284 also includes a bearing surface 292 having a correspondingly shaped curved surface portion 292*a* and an upwardly inclined linear surface portion 292*b*. As will be clear from FIGS. 24 and 25, the various surface portions 288*a*, 288*b*, 292*a*, 292*b* of each bearing surface 288, 292 are in intimate contact when the movable rail 245 is in the second position. It is this intimate contact that locks the movable rail 245 in the closed position. When one of the movable rails 245 is moved from the closed position to the open position (i.e. the position adopted by the right hand movable rail 245 in FIGS. 22 to 25), the bearing surfaces 288, 292 cooperate to guide the movable rail 245 upwardly, from the first position to a third position which is elevated above the first position. More particularly, the curved surface portion 288*a* provided by the shoulder 290 contacts the curved surface portion 292*a* and the linear surface portion 292*b* thereby guiding the movable rail 245 upwardly.

The operation of the railway track crossing 240 will now be described with reference to FIGS. 17 to 27 of the accompanying drawings.

When it is not intended that rolling stock should pass through the railway track crossing 240 and, therefore, when the railway track crossing 240 is not in use, the controllable drive mechanism is set so that the actuating member 262 adopts a neutral transverse position in which it does not apply any force to either of the movable rails 245. As a result both of the movable rails 245 adopt the closed position illustrated in FIGS. 17, 20 and 21. Furthermore, in the absence of any load applied to the movable rails 245 by rolling stock, the movable rails 245 are biased into the elevated first position by the biasing means 274 so that the running surfaces 270 of the wing rail sections 246 are elevated slightly above the running surface 272 of the crossing nose 242 (see FIG. 21).

Figure 22:
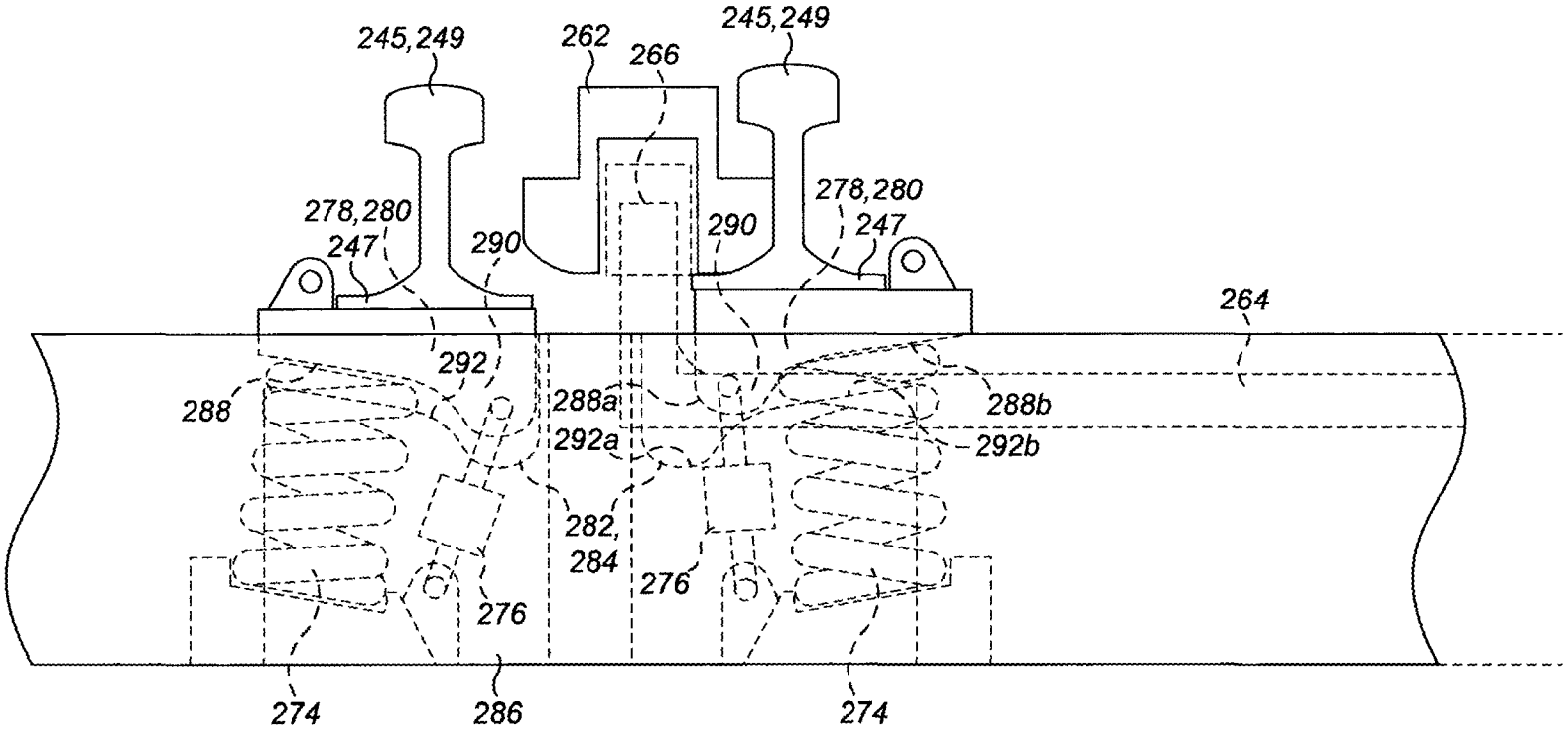
FIGS. 22 and 23 are cross-sectional views respectively along the lines C-C and D-D of FIG. 18 showing the movable rail in the closed position in an unloaded state.
Figure 23:
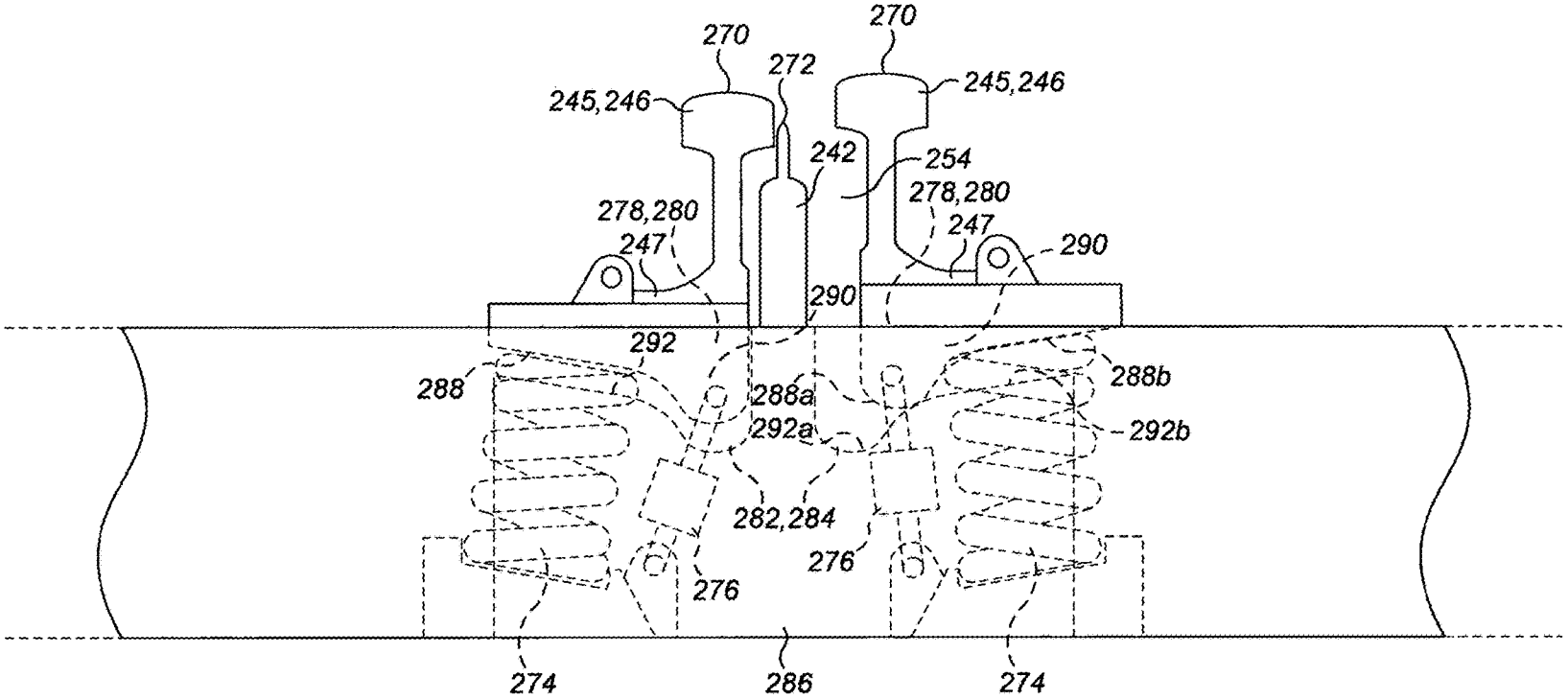

When it is intended that rolling stock should pass through the railway track crossing 240, a points arrangement is operated in a conventional manner to move switch blades to select a desired route for the rolling stock. At the same time, the controllable drive mechanism is operated to displace the actuator arm 264, and hence the actuating member 262, transversely to move the appropriate one of the movable rails 245 from the closed position to the open position. This is best seen in FIGS. 18, 22 and 23 which illustrates the movement of the appropriate movable rail 245 to allow rolling stock to follow the straight route 212 illustrated in FIG. 16. The movement of the movable rail 245 opens a groove 254 between the wing rail section 246 and the crossing nose 242 through which the wheel flanges 256*a* of rolling stock wheels 256 can pass.

As rolling stock approaches the railway track crossing 240, the movable rail 245 that is in the closed position, and along which it is intended that rolling stock should travel, is gradually loaded by the wheels 256 of the approaching rolling stock and is thereby displaced downwardly from the elevated first position shown in FIGS. 22 and 23 to the second position shown in FIGS. 24 and 25. As the movable rail 245 is displaced downwardly from the elevated first position to the second position, the convex profile section 280 engages the concave profile section 284 as shown in FIGS. 24 and 25 and the movable rail 245 is thus locked in the closed position. As the wheelsets of rolling stock pass through the railway track crossing 240, the load applied to the locked movable rail 245 is intermittently reduced, typically for short periods of a few seconds each. During these short periods, the dampers 276 help to prevent the locked movable rail 245 from springing upwardly from the second position to the first position under the action of the biasing means 274.

After the rolling stock has passed through the railway track crossing 240 and load is no longer applied by the wheels 256 to the locked movable rail 245, the movable rail 245 is biased by the biasing means 274 back to the elevated first position shown in FIGS. 22 and 23. The movement of the movable rail 245 from the second position to the elevated first position is retarded by the dampers 276, thereby ensuring a controlled upward movement. Finally, the controllable drive mechanism is operated to displace the actuator arm 264, and hence the actuating member 262, transversely to a neutral position thereby allowing the displaced movable rail 245 to move from the open position shown in FIGS. 22 to 25 to the closed position shown in FIGS. 20 and 21 to thereby close the groove 254. The railway track crossing 240 is, thus, returned to the neutral state shown in FIGS. 17, 20 and 21. Movement of the displaced movable rail 245 from the open position to the closed position may occur due to the inherent stiffness and natural bend of the movable rail 245 and may be assisted by the biasing means 274. The dampers 276 may also help to retard the movement of the movable rail 245 from the open position to the closed position.

In the unlikely event that the railway track crossing 240 should fail when it is in the neutral state with both of the movable rails 245 in the closed position (for example due to failure of some part of the actuator arrangement 260), rolling stock can still safely pass through the crossing 240 without significantly increasing the derailment risk. In this mode of operation, the wing rail sections 246, and hence the movable rails 245, can be displaced transversely by the wheel flanges 256*a* of passing rolling stock. The railway track crossing 240 thus acts like a conventional "passive" swing wing crossing. The dampers 276 also help to prevent the movement of the movable rail 245 from the open position to the closed position after each wheel flange 256*a* has passed through the groove 254.

Although extremely unlikely, it is possible that the railway track crossing 240 could fail when set for a particular route but that rolling stock may need to pass through the railway track crossing 240 along the other route. For example, the railway track crossing 240 may be set for the straight route as shown in FIG. 18 whereas rolling stock may need to follow the turnout route. As will now be explained, the railway track crossing 240 advantageously allows rolling stock to follow the correct route without derailment, albeit at much reduced speed, even when the crossing 240 is set for an incorrect route.

Referring again to FIG. 18, when rolling stock is executing a trailing-point movement along the turnout route in the converging direction of the rails 244 forming the crossing nose 242, the wheel flanges 256*a* engage the flared section 258 of the closed wing rail section 246 and push it, and hence the movable rail 245, transversely to the open position. There will, of course, be a gap between the crossing nose 242 and the other wing rail section 246, which has been displaced to the open position by the actuator arrangement 260, that will need to be traversed by the wheels 256. In extreme cases, the wheels 256 may fall to ground or onto a support 243. However, it will be seen from FIG. 27 that the upper surface of the actuating member 262 includes ramp sections 263 at longitudinally opposite ends thereof. These ramp sections 263 help to re-rail the wheels 256 onto the movable rail 245 that has been displaced to the open position by the actuator arrangement 260 and with which the actuating member 262 is, therefore, in contact.

When rolling stock is travelling in the opposite direction and executing a facing-point movement along the turnout route in the diverging direction of the rails 244 forming the crossing nose 242, the wheels 256 derail and ride down the ramp section 263 of the actuating member 262 before the wheel flanges 256*a* are captured by the crossing nose 242 and re-lifted to follow the appropriate one of the diverging rails 244.

In all of the scenarios described above in which the railway track crossing 240 is incorrectly set to allow the passage of rolling stock along the desired route, it will be understood that the check rails 234 (see FIG. 16) ensure that the rolling stock ultimately follows the correct route.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

For example, although the embodiment illustrated in FIGS. 1 to 4 has only first and second pairs of stock rails 12, 14 which enable the points arrangement 10 to select between first and second routes through the railway track junction, further pairs of stock rails could be provided with which the switch rails 16 can cooperate thereby enabling more than two routes to be selected.

Although three transversely-spaced recesses 132 are shown in the illustrated embodiments of the points operating apparatus 122, 1122 described with reference to FIGS. 5 to 15, it will be understood that this is illustrative only and that any suitable number of recesses 132 can be provided. In practice, it will be sufficient to provide one recess 132 per route. This means that if the points arrangement 110 comprises only two pairs of stock rails 112, 114 representing first and second routes, only two transversely-spaced recesses 132 will be needed because the switch rails 116 will only be required to move between two positions, namely a first position to select the first route and a second position to select the second route.

In the points operating apparatus 1122 described with reference to FIGS. 14 and 15, the rack gear 164 is arranged below the pinion gears 162, 166*a*, 166*b*, with the teeth of the rack gear 164 projecting upwardly. The rack gear 164 could instead be arranged above the pinion gears 162, 166*a*, 166*b*, with the teeth of the rack gear 164 projecting downwardly.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

Any combination of the above-described features in all possible variations thereof is encompassed by the present invention unless otherwise indicated herein or otherwise clearly contradicted by context.

The invention claimed is:

1. A railway points arrangement for a railway track junction, the railway points arrangement comprising:

at least first and second pairs of longitudinally-extending, parallel-spaced static stock rails defining respectively a first route and a second route; and a pair of longitudinally-extending, parallel-spaced switch rails movable vertically and transversely between a first transverse position in alignment with the first pair of stock rails to select the first route and a second transverse position in alignment with the second pair of stock rails to select the second route;

wherein at least one of the movable switch rails cooperates with at least one stock rail of the first pair of stock rails when the movable switch rails are in the first transverse position and with at least one stock rail of the second pair of stock rails when the movable switch rails are in the second transverse position, said at least one switch rail and said at least one stock rail being shaped to define a mating profile which aligns the switch rail and stock rail and prevents transverse movement of the switch rail relative to the stock rail when the switch rails are in the first transverse position or the second transverse position, the mating profile being formed by an upper surface of the stock rail and a lower surface of the switch rail, and wherein the mating profile is arranged to permit said at least one switch rail to be moved in a vertical direction relative to said at least one stock rail to engage and disengage the mating profile and thereby permit transverse movement of the switch rails between the first and second transverse positions.

2. The points arrangement according to claim 1, wherein the mating profile is arranged to permit relative longitudinal movement between said at least one switch rail and said at least one stock rail when the switch rails are in the first and second transverse positions.

3. The points arrangement according to claim 1, wherein the mating profile comprises a convex profile section and a complementary concave profile section.

4. The points arrangement according to claim 3, wherein the convex profile section extends upwardly from said at least one stock rail and the concave profile section is formed in said at least one switch rail.

5. The points arrangement according to claim 1, wherein an expansion gap is defined between the facing end surfaces of said at least one switch rail and said at least one stock rail when the switch rails are in the first and second transverse positions.

6. The points arrangement according to claim 1, wherein said at least one switch rail and said at least one stock rail are tapered in the longitudinal direction to define a mitred connection that permits relative longitudinal movement between said at least one switch rail and said at least one stock rail.

7. A railway points operating apparatus for a railway points arrangement comprising at least first and second pairs of longitudinally-extending, parallel-spaced static stock rails defining respectively a first route and a second route and a pair of longitudinally extending switch rails movable between a first position to select the first route and a second position to select the second route, wherein the railway points operating apparatus comprises:

an actuator arrangement for moving the switch rails transversely and vertically about an arc between the first and second positions so that the switch rails are raised and lowered relative to the stock rails during said transverse movement;

a locking arrangement for preventing transverse horizontal movement of the switch rails from the first and second positions; and a support member having an upper surface on which the switch rails are mounted in a spaced relationship, the actuator arrangement being arranged to move the support member about said arc to move the switch rails between the first and second positions, the support member having a lower surface and a plurality of transversely spaced recesses provided on said lower surface.

8. The points operating apparatus according to claim 7, wherein the locking arrangement includes an upwardly extending locking projection which locates in one of said transversely spaced recesses when the switch rails are in the first and second positions to prevent transverse horizontal movement of the support member.

9. The points operating apparatus according to claim 8, wherein the locking projection has a substantially semi-circular profile which is complementary to the semi-circular profile of each recess.

10. The points operating apparatus according to claim 7, wherein the actuator arrangement includes an actuating member which cooperates with the support member to move the support member about said arc and thereby move the switch rails between the first and second positions, the actuating member cooperates with the transversely spaced recesses to move the support member about said arc, and the actuating member is disengaged from the transversely spaced recesses when the switch rails are in the first and second positions.

11. The points operating apparatus according to claim 10, wherein the actuating member comprises a rotatable cam member.

12. A railway track crossing comprising:

a fixed crossing nose formed by a pair of diverging rails;

a pair of independently movable rails each having a wing rail section provided on each side of the fixed crossing nose, each rail being movable transversely from a closed position in which the wing rail section contacts the crossing nose to an open position in which the wing rail section is spaced from the crossing nose to form a groove that allows the passage of a wheel flange between the crossing nose and the wing rail section; and an actuator arrangement which is operable to move a selected one of the movable rails from the closed position to the open position, each movable rail being arranged to adopt the closed position in the absence of any force applied to it by the actuator arrangement due to the inherent stiffness and natural bend of the movable rail;

wherein:

each movable rail includes a first mating feature;

the railway track crossing includes a locking element, positioned beneath each movable rail, which includes a second mating feature; and the first mating feature cooperates with the second mating feature to lock the movable rail in the closed position when the movable rail is loaded by the wheels of rolling stock passing through the railway track crossing.

13. The railway track crossing according to claim 12, wherein each movable rail adopts a first position in which the wing rail section is elevated above the crossing nose when the movable rail is unloaded and each movable rail is arranged to move downwardly to a second position when the movable rail is loaded by the wheels of rolling stock passing through the railway track junction, the first and second mating features being arranged to cooperate when the movable rail is loaded and thereby moved to the second position.

14. The railway track crossing according to claim 13, wherein a running surface of the wing rail section is substantially coplanar with a running surface of the crossing nose when the movable rail is loaded and in the second position.

15. The railway track crossing according to claim 13, wherein the railway track crossing includes a plurality of dampers, at least one damper being arranged to retard the movement of each movable rail from the second position to the first position, and the damper is arranged to retard the movement of the movable rail from the open position to the closed position.

16. The railway track crossing according to claim 12, wherein the railway track crossing includes a plurality of biasing means, the biasing means are arranged to bias each movable rail into the elevated first position when each movable rail is not loaded by the wheels of rolling stock, and the biasing means are arranged to bias each movable rail into the closed position.

17. The railway track crossing according to claim 12, wherein the first and second mating features comprise a longitudinally extending concave profile section and a complementary longitudinally extending convex profile section.

18. The railway track crossing according to claim 17, wherein the convex profile section extends downwardly from a lower flange of each movable rail and the concave profile section opens upwardly to accommodate the convex profile section when the movable rail is in the second position.

19. The railway track crossing according to claim 17, wherein each movable rail adopts a first position in which the wing rail section is elevated above the crossing nose when the movable rail is unloaded and each movable rail is arranged to move downwardly to a second position when the movable rail is loaded by the wheels of rolling stock passing through the railway track junction, the first and second mating features being arranged to cooperate when the movable rail is loaded and thereby moved to the second position, the convex profile section and the concave profile section each include a bearing surface configured to guide each movable rail downwardly to the second position when the movable rail is loaded by the wheels of rolling stock passing through the railway track crossing, and the bearing surface is configured to guide each movable rail upwardly, from the first position to a third position that is elevated above the first position, when the movable rail is moved from the closed position to the open position.

* * * * *